US012339073B2

(12) United States Patent
DeCourcy et al.

(10) Patent No.: US 12,339,073 B2
(45) Date of Patent: Jun. 24, 2025

(54) METHOD FOR MONITORING A TUBE SHEET OF A HEAT EXCHANGER

(71) Applicant: Arkema Inc., King of Prussia, PA (US)

(72) Inventors: Michael S. DeCourcy, King of Prussia, PA (US); Kishlay Tripathy, King of Prussia, PA (US)

(73) Assignee: Arkema Inc., King of Prussia, PA (US)

( * ) Notice: Subject to any disclaimer, the term of this patent is extended or adjusted under 35 U.S.C. 154(b) by 0 days.

(21) Appl. No.: 18/282,244

(22) PCT Filed: May 9, 2022

(86) PCT No.: PCT/US2022/028282

§ 371 (c)(1),
(2) Date: Sep. 15, 2023

(87) PCT Pub. No.: WO2022/240723

PCT Pub. Date: Nov. 17, 2022

(65) Prior Publication Data

US 2024/0159482 A1 May 16, 2024

Related U.S. Application Data

(60) Provisional application No. 63/186,931, filed on May 11, 2021.

(51) Int. Cl.

| | |
|---|---|
| ***F28F 27/00*** | (2006.01) |
| ***F28D 7/16*** | (2006.01) |
| ***F28D 21/00*** | (2006.01) |

(52) U.S. Cl.

CPC ..... *F28F 27/00* (2013.01); *F28D 7/16* (2013.01); *F28D 2021/0054* (2013.01); *F28F 2200/00* (2013.01)

(58) Field of Classification Search

CPC ..... F28F 27/00; F28F 2200/00; F28D 7/16; F28D 2021/0054; F28D 2021/0022; F28D 2021/0059; F28G 15/003

See application file for complete search history.

(56) References Cited

U.S. PATENT DOCUMENTS

| | | | |
|---|---|---|---|
| 4,222,540 | A | 9/1980 | King et al. |
| 4,977,529 | A | 12/1990 | Gregg et al. |

(Continued)

FOREIGN PATENT DOCUMENTS

| | | | |
|---|---|---|---|
| WO | WO2009049031 | A1 | 4/2009 |
| WO | WO2015002451 | A1 | 1/2015 |
| WO | WO2018232508 | A1 | 12/2018 |

OTHER PUBLICATIONS

MDPI "Monocular Stero Measurement Using High-Speed Catadioptric Tracking"; Shaopeng Hu et al; Sensors 2017, 17, 1839, doi: 10.3390/s17081839 pp. 1-29.

(Continued)

*Primary Examiner* — Omeed Alizada
(74) *Attorney, Agent, or Firm* — Debodhonyaa Sengupta

(57) ABSTRACT

Shell-and-tube devices typically require regular maintenance. Described herein is an automated method for tracking the status of individual tubes during maintenance activities and recording status data for review and analysis. Status data may optionally be reported in real-time summary format and/or used to predict time-to-completion. The method minimizes omission errors and helps to reduce the expense of performing maintenance activities in shell-and-tube devices, including shell-and-tube reactors and heat exchangers.

19 Claims, 8 Drawing Sheets

(56) References Cited

U.S. PATENT DOCUMENTS

| | | | |
|---|---|---|---|
| 6,362,875 | B1 | 3/2002 | Burkley |
| 6,960,333 | B2 | 11/2005 | Blanda, Jr. et al. |
| 6,981,404 | B2 | 1/2006 | Johns et al. |
| 7,115,776 | B2 | 10/2006 | Hammon et al. |
| 7,115,777 | B2 | 10/2006 | Allmendinger et al. |
| 8,063,778 | B2 | 11/2011 | Johns et al. |
| 9,440,903 | B2 | 9/2016 | Decourcy et al. |
| 10,168,527 | B2 | 1/2019 | Tripathy |
| 2007/0087311 | A1 | 4/2007 | Garvey, III et al. |
| 2008/0045748 | A1 | 2/2008 | Jinno et al. |
| 2009/0112367 | A1 | 4/2009 | Decourcy et al. |
| 2010/0063304 | A1 | 3/2010 | Olbert et al. |
| 2010/0097221 | A1 | 4/2010 | Kreiner et al. |
| 2011/0144356 | A1 | 6/2011 | Taheri et al. |
| 2012/0062691 | A1 | 3/2012 | Fowler et al. |
| 2012/0097378 | A1 | 4/2012 | Gianazza et al. |
| 2014/0184781 | A1 | 7/2014 | Au et al. |
| 2014/0290368 | A1 | 10/2014 | Guo et al. |
| 2016/0046498 | A1 | 2/2016 | Caton et al. |
| 2016/0220974 | A1 | 8/2016 | Schmidt |
| 2020/0003503 | A1 | 1/2020 | Colombo et al. |
| 2020/0068125 | A1 | 2/2020 | Michael et al. |
| 2021/0065356 | A1* | 3/2021 | Fisher ..... G01N 35/0099 |
| 2021/0179375 | A1* | 6/2021 | Okumura ..... B41J 15/04 |

OTHER PUBLICATIONS

Feb. 2013 Problemy Eksploatacji—Maintenance Problems; "Multi-Mirror System for High-Speed Camera Monitoring Applications"; Garbacz et al; Institute for Sustainable Technologies—National Research Institute, Radom piotr. garbacz@itee.radom.pl, piotr. czajka@itee.radom.pl; pp. 117-128.

Sulzer Chemtech "Falling Film Melt Crystallization-Technology for Production of Glacial Acrylic Acid" ; chemtech@sulzer.com; pp. 1-2.

Sulzer Chemtech "Fractional Crystallization" 28.56.06.40-IV06-50; pp. 1-15.

The National Academies of Science Engineering Medicine—The National Academies Press; http://nap.edu/12896; "Seeing Photons: Progress and Limits of Visible and Infrared Sensor Arrays (2010)" [Book details 194 Pages ISBN 978-0-309-15304-1/DOI 10.17. 17226/12896.

Density—Product Overview—"The Occupany Analytics Platform for Connected Buildings" pp. 1-18.

Applied Industrial Catalysis, vol. 1—Chapter 9 "Oxychlorination of Ethylene"; J.S. Naworski and E.S. Velez pp. 239-273.

* cited by examiner

METHOD FOR MONITORING A TUBE SHEET OF A HEAT EXCHANGER

This application is a national stage application under 35 U.S.C. § 371 of PCT/US2022/028282, filed May 9, 2022, which claims benefit to U.S. patent application Ser. No. 63/186,931, filed May 11, 2021.

FIELD OF THE INVENTION

The invention relates to a method for monitoring a tube sheet of a heat exchanger.

BACKGROUND OF THE INVENTION

Shell-and-tube heat exchangers can comprise hundreds or thousands of tubes. Shell-and-tube heat exchangers typically require regular maintenance, such as cleaning and inspection of the individual tubes, to assure reliability and safe operation. Further, shell-and-tube reactors require regular catalyst replacement for optimal productivity. Due to the large number of tubes present, maintenance activities require significant manpower expense and extended periods of process downtime to complete; thus, there is a strong economic incentive to perform these activities quickly and efficiently. Additionally, catalyst installation within shell-and-tube reactors requires adherence to precise loading specifications. Failing to properly perform maintenance activities on every tube within a shell-and-tube exchanger can lead to costly process downtime, equipment damage, and shortened catalyst service life within reactors. Described herein is an automated method for tracking the status of individual tubes during maintenance activities and recording status data for review and analysis. Status data may optionally be reported in real-time summary format and/or used to predict time-to-completion. The described method minimizes omission errors and helps to reduce the expense of performing maintenance activities in shell-and-tube heat exchangers, including shell-and-tube reactors.

SUMMARY OF THE INVENTION

According to one aspect of the invention, for example, a method for monitoring a tube sheet comprising a plurality of tube ends arranged in a fixed pattern of rows (R) and columns is provided. The method comprises the steps of:

a) assigning a unique identifier to each of said plurality of tube ends,
b) acquiring a digital image (D) of at least a portion of the tube sheet at an acquisition time (T),
c) determining an attribute for each of the tube ends within said digital image, and
d) recording data in a relational database for each tube end within said digital image, said data including:
   i. the acquisition time (T),
   ii. the unique identifier for the tube end, and
   iii. a state of the attribute at acquisition time (T).

According to another aspect of the invention, a method for monitoring a status of the shell and tube device during a maintenance activity comprises:

a) assigning a unique identifier to each of said tube ends,
b) selecting an attribute with at least two possible states,
c) acquiring an initial digital image (Di) of at least a portion of the tube sheet at an acquisition time (Ti),
d) determining an initial state of the attribute for each of the tube ends within said initial digital image (Di), e) creating an initial data record in a relational database for each tube end within said initial digital image (Di), said initial data record including:
   i. the initial acquisition time (Ti),
   ii. the unique identifier for the tube end, and
   iii. the initial state of the attribute at the initial acquisition time (Ti).

According to yet another aspect of the invention, an optical method for monitoring a status of the shell and tube device during a maintenance activity comprises:

a) assigning a unique identifier to each of said tube ends,
b) positioning at least one digital camera such that at least a portion the tube sheet lies within a field of view of the at least one digital camera,
c) positioning a plurality of colored tube caps on the tube ends, said plurality of tube caps including tube caps having a first color and tube caps having a second color that is different from the first color,
d) acquiring an initial digital image (Di) of at least a portion of the tube sheet at an acquisition time (Ti),
e) determining an initial color of each of the tube ends within said initial digital image (Di), and
f) creating an initial data record in a relational database for each tube end within said initial digital image (Di), said data record including:
   i. the initial acquisition time (Ti),
   ii. the unique identifier for the tube end, and
   iii. the initial color for the tube end at the initial acquisition time (Ti).

According to still another aspect of the invention, an optical method for monitoring a status of the shell and tube device (e.g., reactor) during a particulate catalyst loading activity comprises:

a) placing a plurality of plugging plates on said tube sheet such that all of the tube ends are covered, each plugging plate comprising a disk recess for installing a colored indicator disk,
b) assigning a unique identifier to each of said plurality of plugging plates,
c) positioning at least one digital camera such that at least a portion of the plurality of plugging plates lie within a field of view of the at least one digital camera,
d) installing a plurality of colored indicator disks in the disk recesses, said plurality of colored indicator disks including at least one disk having a first color and at least one disk having a second color that is different than the first color,
e) acquiring an initial digital image (Di) of at least a portion of the plurality of plugging plates at an initial acquisition time (Ti),
f) determining an initial color of each of the colored indicator disks within said initial digital image (Di), and
g) creating an initial data record in a relational database for each plugging plate within said initial digital image (Di), said data record including:
   i. the initial acquisition time (Ti),
   ii. the unique identifier for the plugging plate,
   iii. the initial color for the colored indicator disk at the initial acquisition time (Ti).

BRIEF DESCRIPTION OF THE DRAWING FIGURES

DETAILED DESCRIPTION OF THE INVENTION

(A) System for Monitoring Shell and Tube Device

Figure 1:
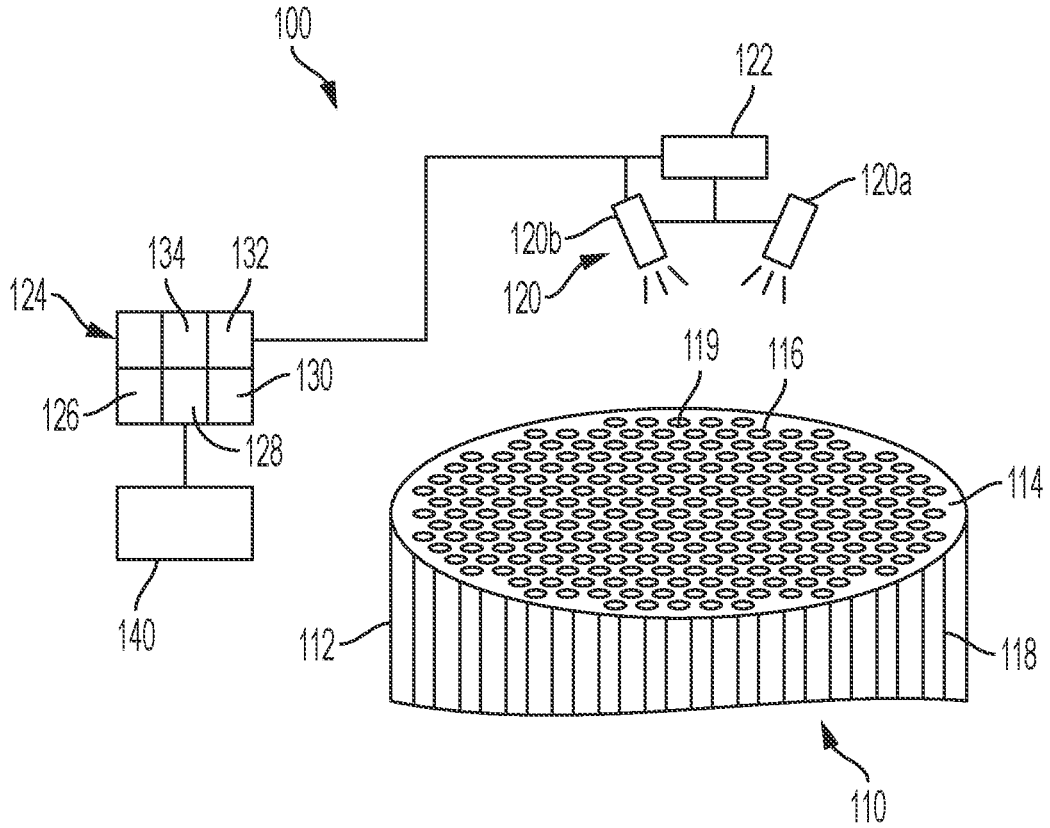
FIG. 1 depicts a system for monitoring a shell and tube device.

FIG. 1 depicts a system 100 for monitoring a shell and tube device 110. Shell and tube device 110, which does not necessarily form part of system 100, comprises a hollow shell 112 (a portion of which is shown) including a tube sheet 114 mounted to an end thereof. Tube sheet 114 has a series of holes 116 defined therethrough. Tubes 118 are mounted to respective holes 116 and positioned within hollow shell 112. Shell 112 is shown cut away to reveal the tubes 118. Ends 119 of the tubes 118 are exposed through the holes 116. The tubes 118 and their respective holes/passages may be circular, as shown, square, rectangular, and so forth.

System 100 generally comprises an Imaging Device 120 that is positioned above holes 116. Imaging Device 120 is configured for viewing, or more generally detecting, holes 116. As will be described in greater detail below, Imaging Device 120 may comprise one camera, for example. Alternatively, Imaging Device 120 may comprise multiple Imaging Devices 120*a* and 120*b*, for viewing holes 116 at different angles and vantage points. Imaging Devices 120 may be stationary. Alternatively, Imaging Device 120 may be mounted to a mobile device 122, such as an X-Y-Z translation stage, X-Y translation stage, or a vehicle for moving Imaging Device 120 with respect to holes 116.

Imaging Device 120 is configured to communicate data relating to the color, condition and/or position (for example) of the tube ends 119 to a computer 124. Computer 124 may include an image processor 126, memory 128, clock 130, programming software 132, and a relational database 134 (among other features). Processor 126 is configured to analyze the data related to the tube ends 119, as will be described below. Computer 124 is connected to a display 140 for displaying the analyzed data, as will also be described below. Interconnections between display 140, Imaging Device 120 and computer 124 may be either wired or wireless, for example.

Further details and alternative features in connection with system 100 and device 110 are provided hereinafter.

(B) Shell and Tube Device

Figure 2A:
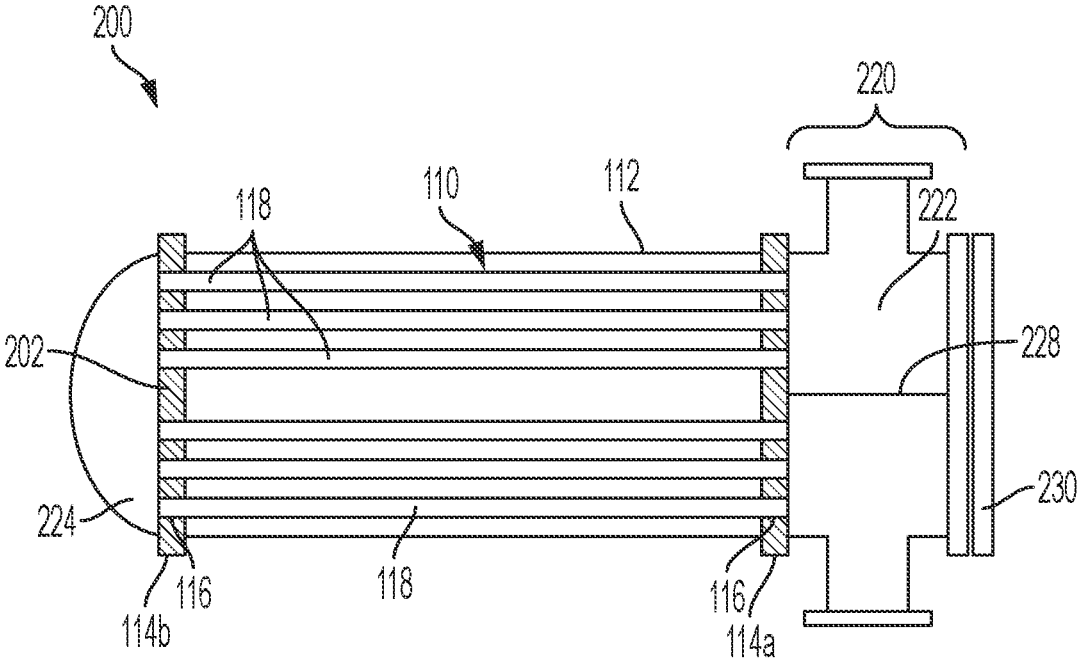
FIG. 2A depicts an exemplary embodiment of a horizontally oriented shell and tube heat exchanger.
Figure 3A:
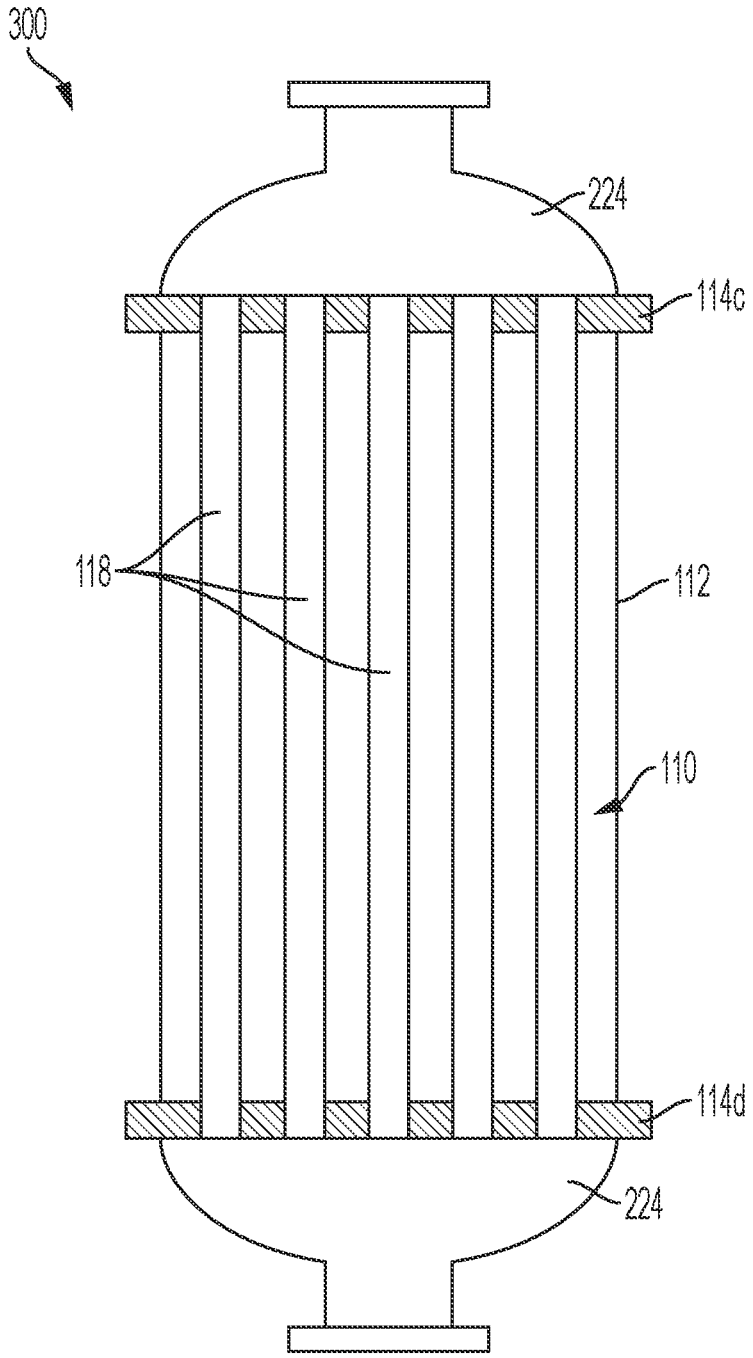
FIG. 3A depicts another exemplary embodiment of a vertically oriented shell and tube heat exchanger.

The shell and tube device 110 is shown schematically in FIG. 1. Shell and tube device 110 may form part of a heat exchanger, such as shown in FIGS. 2A and 3A. Turning now to the shell and tube heat exchangers 200 and 300 of FIGS. 2A and 3A, heat exchangers 200 and 300 generally include shell 112 defining a hollow interior, and tubes 118 positioned within the hollow interior.

By way of background, a shell and tube heat exchanger is a common type of heat exchanger used in industry. It is named for its two major components, i.e., one or more heat transfer tubes 118 mounted inside of a cylindrical shell 112. The purpose of a shell-and-tube heat exchanger is to transfer heat between two fluids. Each fluid may be a liquid or a gas. In industrial practice, it is common for at least one of these fluids to be either liquid water or steam.

Within a shell and tube heat exchanger 200, 300, one fluid flows through the interior of the tubes 118 (designated the "tube side fluid") and the other fluid flows around the outside of the tubes 118 but within the shell 112 (designated the "shell side fluid"). The heat exchanger is constructed such that the two fluids do not come into direct contact with each other. Heat is transferred from one fluid to the other by passing heat through the walls of tube 118, flowing either from tube side to shell side or vice versa. In order to transfer heat efficiently, hundreds or even thousands of tubes 118 (collectively, the "tube bundle") may be used in a single exchanger.

Shell-and-tube heat exchangers 200 and 300 also include one or more tube sheets, heads, and, optionally, other components such as baffles, tie rods, spacers and expansion joints. More particularly, tube sheets 114*a*, 114*b*, 114*c* and/or 114*d* (referred to either collectively or individually as tube sheet(s) 114) are mounted to the ends of shell 112. Tube sheets 114 are plates or forgings having planar opposing surfaces and comprising holes 116 through which the tubes 118 are inserted. The required thickness of the tube sheet 114 is primarily a function of the operating pressure of the specific shell-and-tube exchanger. The ends of the tubes 118 are secured to the tube sheet 114 by welding, or by mechanical or hydraulic expansion, such that fluid on the shell side is prevented from mixing with fluid on the tube side.

The geometry of the tubes 118 determines the number of tube sheets 114 which are required. If straight tubes are used, such as in FIGS. 1, 2A and 3A, two tube sheets 114 may be required. Alternatively, if the tubes 118 are bent into the shape of the letter "U" (known as U-tubes), only one tube sheet 114 may be required.

Figure 2B:
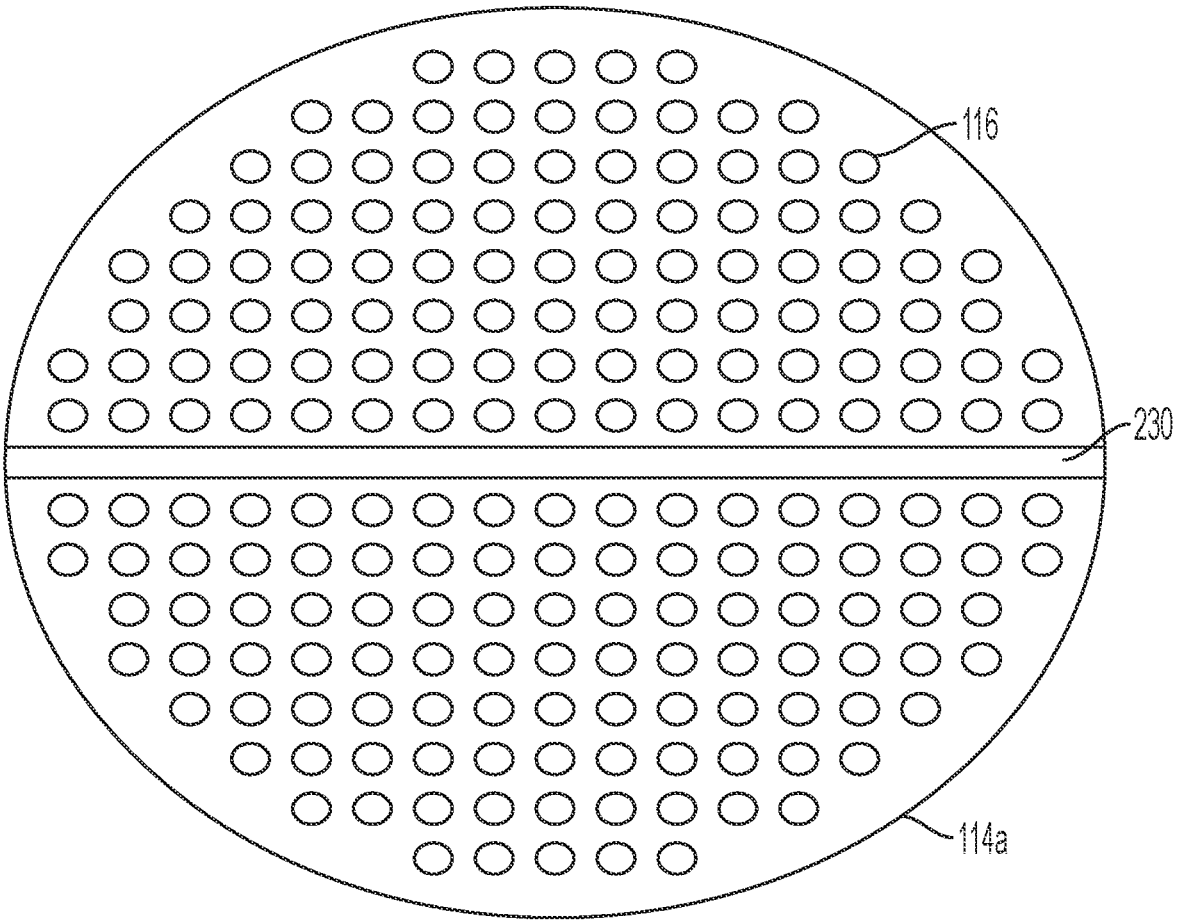
FIG. 2B depicts one of the tube sheets of the heat exchanger of FIG. 2A.
Figure 3B:
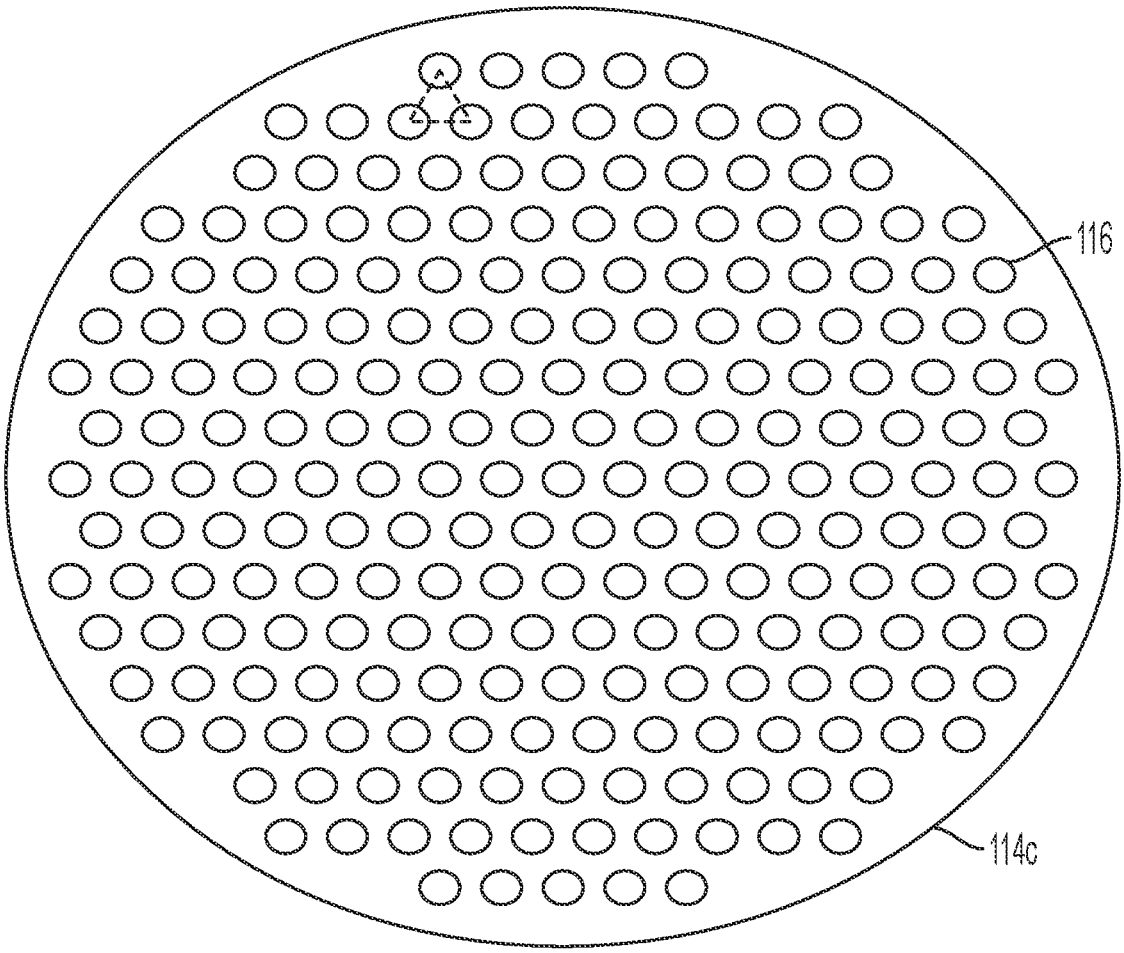
FIG. 3B depicts one of the tube sheets of the heat exchanger of FIG. 3A.

Holes 116 in the tube sheet 114 are typically arranged in one of two geometric configurations, namely, triangular or square. Tube sheets 114 utilize a fixed center-to-center distance between adjacent tubes 118 referred to as the "tube pitch." Such uniformity of the configuration simplifies exchanger design and construction. A common tube pitch is 1.25 times the outside diameter of the tubes 118. Triangular configurations (see FIG. 3B) are often used to obtain high heat transfer and compactness, whereas square configurations (see FIG. 2B) are generally preferred for services where it is necessary to regularly extract the tube bundle from the shell and clean the outside surface of the tubes.

Heads 220 are required for shell-and-tube heat exchangers to contain the tube side fluid and to provide the desired flow path through the exchanger. Typically, for each tube sheet 114 there is a corresponding head. Heads having a generally cylindrical shape are referred to as "channels" 222 (see FIG. 2A), and those having a generally domed shape are referred to as "bonnets" 224 (See FIGS. 2A and 3A). In some cases, the head may also incorporate one or more pass partition plates 228 (FIG. 2A) to direct tube-side fluid flow through specific tubes. In these cases, the surface of the tube sheet 114*a* may further comprise grooves 230 (FIG. 2B) to stabilize the partition plates 228 and any associated sealing gaskets. Heads 220 may be welded in-place or attached to the shell 112 with flanges. Flanged bonnets or channels with removable covers 230 (FIG. 2A) are preferred in cases where it is necessary to provide access to tube sheet 114 and tubes 118 for maintenance and inspection.

Shell and tube heat exchangers 200, 300 are used broadly throughout industry, finding use in electrical power generation, industrial refrigeration, and petrochemical processing, to name a few. Shell and tube heat exchangers may be installed in a horizontal orientation (FIG. 2A) or a vertical orientation (FIG. 3A). By convention, within industrial facilities, shell-and-tube heat exchangers are named on the basis of their process function. For example, typical industrial applications of shell-and-tube heat exchangers include a condenser, reboiler, preheater, boiler, superheater, quench exchanger, Transfer Line Exchanger (TLE), evaporator, waste heat boiler, recuperator, cross-exchanger and process heater. Often, multiple heat exchangers are used within a single industrial system; for example, industrial refrigeration systems may comprise both evaporators and condensers, and petrochemical distillation systems may comprise both reboilers and condensers.

Further information regarding shell-and-tube heat exchangers may be found in Perry's Chemical Engineers' Handbook, $6^{th}$ Ed., 2008, especially Section 11: Heat-Transfer Equipment and associated FIGS. 11-1 and 11-2. This handbook is incorporated by reference herein in its entirety and for all purposes.

(C) Alternative Applications for Shell and Tube Device

The shell and tube device 110 may also be incorporated into other industrial apparatus/process systems, such as those described hereinafter.

High strength shell and tube heat exchangers, comprising U-tube bundles, may be employed as steam generators for nuclear power plants, such as disclosed in U.S. Pat. No. 4,200,061, which is incorporated by reference herein in its entirety.

The shell and tube device may be incorporated into a falling film exchanger, such as the falling film melt crystallizers used to purify (meth)acrylic acid.

The shell and tube device may be incorporated into a reaction system as a closely-coupled quench exchanger that is used to rapidly cool temperature-sensitive products such as Hydrogen Cyanide or Nitrogen Oxides as they exit the reaction zone, such as disclosed in U.S. Pat. No. 6,960,333, which is incorporated by reference herein in its entirety. Similarly, Transfer Line Exchangers (TLE's) are used to rapidly cool high-temperature process gas as it exits an ethylene furnace.

Within the chemical manufacturing industry, the shell-and-tube device 110 may also be utilized as a chemical reactor. Within these so-called "shell-and-tube reactors" (also known as "fixed-bed reactors"), the tube side fluid typically comprises chemical reactants which are converted into one or more chemical products. Generally, commercial scale shell-and-tube reactors are large pieces of equipment comprising from 1,000 to 50,000 tubes and having tube sheets that range from between 1 to 10 meters in diameter. At such a scale, the heads of these shell-and-tube reactors can easily enclose a volume large enough for workers to physically enter and perform work and, when the shell-and-tube reactor is vertically oriented (as shown in FIG. 3A), the upper planar surface of the top tube sheet 114*c* may become a de facto "floor" for the enclosed work area.

Frequently, one or more particulate catalysts are placed inside the tubes of a shell-and-tube reactor to promote formation of the desired chemical products. By passing a heat transfer fluid through the shell side of the shell-and-tube reactor, the tube-side reaction temperature may be tightly controlled to maximize product yield and extend catalyst life. Unique tube configurations and shell-side baffle designs may also be utilized to further optimize temperature control.

The chemical conversions performed within shell-and-tube reactors may be exothermic (heat releasing) or endothermic (heat absorbing) reactions. In the case of highly exothermic reactions, such as for example hydrocarbon oxidation reactions, it is common for high-boiling-point fluids such as molten inorganic salts, kerosene, or organic heat transfer fluids (e.g., DOWTHERM™) to be used as the shell side fluid. Custom mechanical design features and specialized materials of construction for tubes and tube sheets are also typically used to ensure safe operation at elevated operating temperatures and pressures used for the chemical reaction.

The production of acrylic acid is but one well-known example of a commercial hydrocarbon oxidation process employing shell-and-tube devices as reactors. The chemical conversion involves two sequential, exothermic reaction steps in which propylene is first oxidized to the intermediate acrolein and then the acrolein is further oxidized to acrylic acid. Numerous solid Mixed Metal Oxide (MMO) particulate-type catalysts have been developed to facilitate this two-stage oxidation process and methods for preparing these catalysts are well documented in the literature. Fixed catalyst beds are assembled in the reactors by loading one or more particulate-type catalysts into the tubes of the reactor. As the process gases flow through the tubes, the gases come into direct contact with the MMO catalyst particles and the heat of reaction is transferred through to tube walls to the shell-side coolant.

At the present time, commercial-scale propylene-to-acrylic acid processes use one of three primary configurations of shell-and-tube type reactors: Tandem reactors, Single Reactor Shell ("SRS") reactors, and Single Shell Open Interstage ("SSOI") reactors. As a group, these commercial shell-and-tube reactors may comprise from about 12,000 up to about 22,000 tubes in a single reaction vessel, and may have production capacities of up to 100 kT/year (220,000,000 pounds per year) of acrylic acid. Certain large-scale commercial reactors may comprise from 25,000 up to about 50,000 tubes in a single reaction vessel, with production capacities of up to 250 kT/year (550,000,000 pounds per year). U.S. Pat. No. 9,440,903, which is incorporated by reference herein, provides descriptions of each of these three reactor configurations and their respective capabilities for producing acrolein and acrylic acid.

The production of Ethylene Oxide is another example of a commercial process employing a shell-and-tube device as a reactor. The shell and tube device 110 may be provided in the form of a commercial ethylene epoxidation reactor, comprising for example up to 12,000 tubes. These tubes are typically loaded with Epoxidation catalysts comprising silver and additionally a promoter component, such as rhenium, tungsten, molybdenum and chromium, and a coolant is circulated through the shell side of the reactor. Reference is made to U.S. Pat. No. 4,921,681 and U.S. Pat. App. Nos. 2009/0234144 and 2014/0135513, which are each incorporated by reference herein in their entirety.

The oxychlorination of ethylene to 1,2-Dichloroethane (also known as EDC) is yet another example of a chemical process employing shell-and-tube devices. In this process, the tubes within the shell and tube device 110 are typically loaded with particulate catalysts comprising cupric chloride (so-called "Deacon" catalysts) and a coolant is circulated through the shell side of the reactor. In some embodiments, the oxychlorination reaction system may comprise two or more shell and tube devices in series. Reference is made to U.S. Pat. Nos. 6,180,841, 3,892,816, and 5,905,177, which are each incorporated by reference herein in their entirety.

In summary, many other commercially important gas-phase catalytic reactions are performed in shell-and-tube reactors including: the conversion of propylene to acrolein and/or acrylic acid (as described above); the conversion of propane to acrolein and/or acrylic acid; the conversion of glycerol to acrolein and/or acrylic acid; the conversion of tert-butanol, isobutene, isobutane, isobutyraldehyde, isobutyric acid, or methyl tert-butyl ether to methacrolein and/or methacrylic acid; the conversion of acrolein to acrylic acid; the conversion of methacrolein to methacrylic acid; the conversion of o-xylene or naphthalene to phthalic anhydride; the conversion of butadiene or n-butane to maleic anhydride; the conversion of indanes to anthraquinone; the conversion of ethylene to ethylene oxide (as described above); the conversion of propylene to propylene oxide; the conversion of isobutene and/or methacrolein to methacrylonitrile; and the oxychlorination of ethylene to 1,2-dichloroethane (as described above).

(D) Shell and Tube Maintenance

Because of the large number of tubes 118 in a shell and tube device, it takes significant time to complete maintenance and inspection work for each shell and tube device. It is also arduous to track the status and progress of the maintenance task. Omission errors and performance errors can be substantial problems.

The term "omission error" as used herein means the failure to perform a specific maintenance task on a tube 118. For example, an operator could unintentionally skip a tube, resulting in a tube that may not be cleaned, inspected, or loaded with catalyst. The probability of omission errors increases with the number of tubes within the shell-and-tube device and with the duration of the maintenance activity. Many process owners generally believe that omission errors can only be prevented through steps such as a) continuous monitoring/supervision of the labor performing the activity, or b) 100% inspection after the activity is 'complete'. The inventive method described herein functionally provides continuous monitoring/supervision of the labor performing the activity, minimizing the need for 100% inspection.

In contrast, a "performance error" refers to performing a task, but doing so with insufficient quality, or only partially-completing that task. Examples of performance errors include taking tube-wall thickness measurements with an improperly calibrated probe; removing rust from only the first 15 feet of a 20-foot-long tube; or filling tubes with the incorrect type of catalyst. Performance errors tend to be relatively insensitive to the number of tubes within the shell-and-tube device. Additionally, performance errors often affect large numbers of tubes at one time. For example, filing all tubes with material sourced from the same, incorrect pallet of catalyst drums. Addressing omission errors with the method of the present invention both improves efficiency and also makes available more supervisory resources for the prevention of performance errors.

There are many maintenance activities that may performed on the tubes of shell and tube devices. Maintenance activities may include one or more multi-step tasks, and these tasks are typically repeated for each and every tube in the shell and tube device. Examples of maintenance activities which may be beneficially monitored using the method of the present invention, include but are not limited to:

a) Inspection
   i. Video inspection for cleanliness and/or mechanical damage
   ii. Thickness Measurement (e.g., Eddy-current inspection)
   iii. Identification of Blocked Tubes (e.g., IR detection of low-flow tubes)
   iv. Identification of Organic contamination via reflected UV light inspection
b) Cleaning
   i. Sand Blasting
   ii. CO2 Pellet Blasting
   iii. Hydroblasting
   iv. Liquid Nitrogen Blasting
   v. Drilling
   vi. Wire Brushing
   vii. Pigging
   viii. Removal of Coke Accumulations
c) Repair
   i. Re-welding tube-to-tubesheet welds
   ii. Mechanical Plugging of tubes.

For shell and tube devices used as reactors, maintenance activities may also include those activities associated with catalyst changes. Examples of catalyst change activities which may be beneficially monitored using the method of the present invention, include but are not limited to:

a) removal of catalyst from tubes, for example using an "air lance," a fish tape, or a vacuum hose,
b) visually verifying that tubes are empty (i.e., "Light Check"),
c) installation of heat transfer inserts into tubes,
d) installation of catalyst retainers, for example Catalyst Springs or Catalyst clips,
e) loading of ceramic or metallic inert particles into tubes,
f) loading of one or more layers of catalyst into tubes,
g) measurement of catalyst bed outages, and
h) measurement of catalyst load pressure drop (dP).

(E) Process for Monitoring Shell and Tube Device

According to one exemplary method for monitoring a shell and tube device 110 comprising a plurality of tube ends arranged in a fixed pattern of rows (R) and columns (C), the method comprises the general steps of:

a) assigning a unique identifier to each of said plurality of tube ends,
b) acquiring a digital image (D) of at least a portion of the tube sheet at an acquisition time (T),
c) determining a state of an attribute for each of the tube ends within said digital image (D), wherein the attribute has at least two possible states,
d) recording data in a relational database for each tube end within said digital image (D), said data including: the acquisition time (T), the unique identifier for the tube end, and the state of the attribute at acquisition time (T), and
e) optionally, producing a report in the form of one or more of tables, graphs, spreadsheets, or color-coded summary graphics using the recorded data stored in the relational database.

Referring now to the individual steps of the exemplary method of using the system 100 shown in FIG. 1, Imaging Device 120 collects (i.e., acquires) a tube sheet image of the top plane of the tube sheet 114. Tube sheet 114 may or may not be actively illuminated. The Imaging Device 120 (e.g., a digital camera) may or may not be first aligned with a particular column of tube ends 119. In collecting the image, Imaging Device 120 receives light through its aperture, which represents the condition of tube sheet 114, and converts the light into a set of digital measurements.

The acquired measurement data, formatted as an array, is known herein as a Digital Image. The digital image of the tube sheet 114 is then forwarded to processor 126 of computer 124 via Wi-Fi, LAN/PoE (Power over Ethernet) wiring, fiber optics, etc.

The software 132 of the computer 124 creates a unique tube identifier for each tube end 119 visible within the digital image. First, the image processing software locates the geometric center of each tube end 119. The unique identifier is then assigned to each center's (x,y) position in the image array. Preferably, the each tube's unique identifier is provided as a set of Cartesian coordinates of the form (row, column), corresponding to the row and column designations used in the fabrication drawings for the tube sheet. In this way, the software 132 knows which tube(s) it is viewing in the image array and can uniquely identify each one of them.

The image processing software can locate the geometric center of the tube end 119 by performing the following steps:

i. Identify all of the geometric regions of interest (i.e., the circular tube ends) within the image array using the Circle Hough Transform (CHT) function and/or Canny edge detection algorithms within OpenCV or Matlab software. It is noted that there are specific commands within the software to utilize these functions. The commands return variables representing the circle center coordinates (x, y) in the array and also the radius of the circle.

ii. Align image array coordinates with known dimensional data for the tube sheet, in order to map identified circular tube ends to the tube sheet drawing. It is noted that this step may be made easier by utilizing benchmarks in the image to orient the tube sheet drawings.

iii. Correlate the unique tube identifier (row, column) for each tube in the drawing with the (x,y) location coordinates of each circle-center in the image array.

Because the tube sheet 114 is a stationary component, it generally does not move relative to the Imaging Device; consequently, the location of each circle center in the array does not change and this mapping step should only need to be performed once.

Once the software 132 has mapped the tube ends 119, the software 132 then manipulates the image array during various routines using known image-processing algorithms, such as canny edge detection, circle Hough transforms, color detection, and so forth. Following each routine, the processed digital data for each tube end 119 (or group of tube ends) is stored in the relational database 134.

For many of the routines, processor 126 may only analyze the digital data within a sample window located near the center of each tube end 119, which might be represented by a 3×3 region comprising just 9 pixels, for example. In this way, large areas of the image can be masked out (i.e., ignored) to speed image processing.

Turning now to the various routines, the data within the digital image is processed to determine attribute details about each tube end 119 in the image. Generally, an attribute is a feature within the image, such as shape, color, intensity, and/or texture. Each attribute can generally be described by the presence or absence of one or more specific states. Time-stamped data about each tube, including its identifier and its attribute details, are stored in relational database 134 (SQL Software or similar) for later analysis. In one embodiment, the time stamp is provided in Julian date format.

Additional image information, herein referred to as Image Metadata, may also be stored in the relational database. Image Metadata may optionally include GPS coordinates, camera number, a job description (e.g., "July 2020 inspection"), and/or the shell and tube device I.D.

Workspace parameters may also be stored in the relational database, as will be described hereinafter. More particularly, and as previously noted, commercial scale shell-and-tube reactors may have tube sheets that range from between 1 to 10 meters in diameter. At such a scale, the heads of these shell-and-tube reactors can easily enclose a volume large enough for one or more workers to physically enter, creating what is known in industry as a "confined workspace." During Maintenance Activities, the environment within such confined workspaces may be controlled in order to prevent damage to the catalyst, minimize the formation of rust inside the reactor, and protect workers from potential hazards. When performing Maintenance activities, it may therefore be beneficial to measure one or more workspace parameters in order to better control the confined workspace environment.

For example, climate-controlled air (heated or cooled) may be supplied to the confined workspace in order to maintain a preferred internal temperature and/or control relative humidity within the reactor. In one embodiment, one or more temperature measurement devices may be placed within the ductwork of the climate-control system and/or within the confined workspace. In another embodiment, one or more Wi-Fi enabled sensors may be temporarily placed within the confined workspace to continuously monitor the relative humidity (% RH) therein. Time-stamped temperature measurements and/or time-stamped % R H measurements may then be automatically communicated through wired or wireless means to computer 124, stored in the relational database 134, and optionally presented on a visual display 140.

In another example, portable gas analyzers may be used to continuously monitor the confined workspace atmosphere to detect the presence of harmful gases (using so-called "toxic gas detectors"), verify that sufficient oxygen concentration is maintained (using so-called "oxygen meters"), and/or monitor for flammability hazards (using so-called "LEL monitors"). Conventionally, such atmospheric monitoring activity is performed by an individual known as a "hole watch", with analyzer measurement data typically being recorded by hand on paper logsheets. However, in the preferred embodiment, time-stamped measurements from such gas analyzers may be automatically communicated through wired or wireless means to computer 124, recorded in the relational database 134, and optionally presented on visual display 140.

In accordance with safety regulations, it is typically necessary to track the number of workers within a confined workspace and to account for them in the event of an emergency evacuation. Conventionally, this activity is also performed by a "hole watch", again typically using handwritten logsheets. However, in a preferred embodiment, one or more LiDAR devices, such as for example a Density Entry Sensor (available from Density Inc. of San Francisco, CA, USA), may be mounted above entry points, such as manways in the reactor head, to automatically track personnel entering/exiting the workspace. By continuously communicating time stamped entry and exit data through wired or wireless means to computer 124, it is possible to determine in real-time the number of personnel within the workspace during maintenance activities. Storing this time-stamped workspace occupancy data in the relational database 134 allows manpower performance metrics to be calculated, including for example, manpower efficiency-factors and the duration of any work stoppages.

Figure 6:
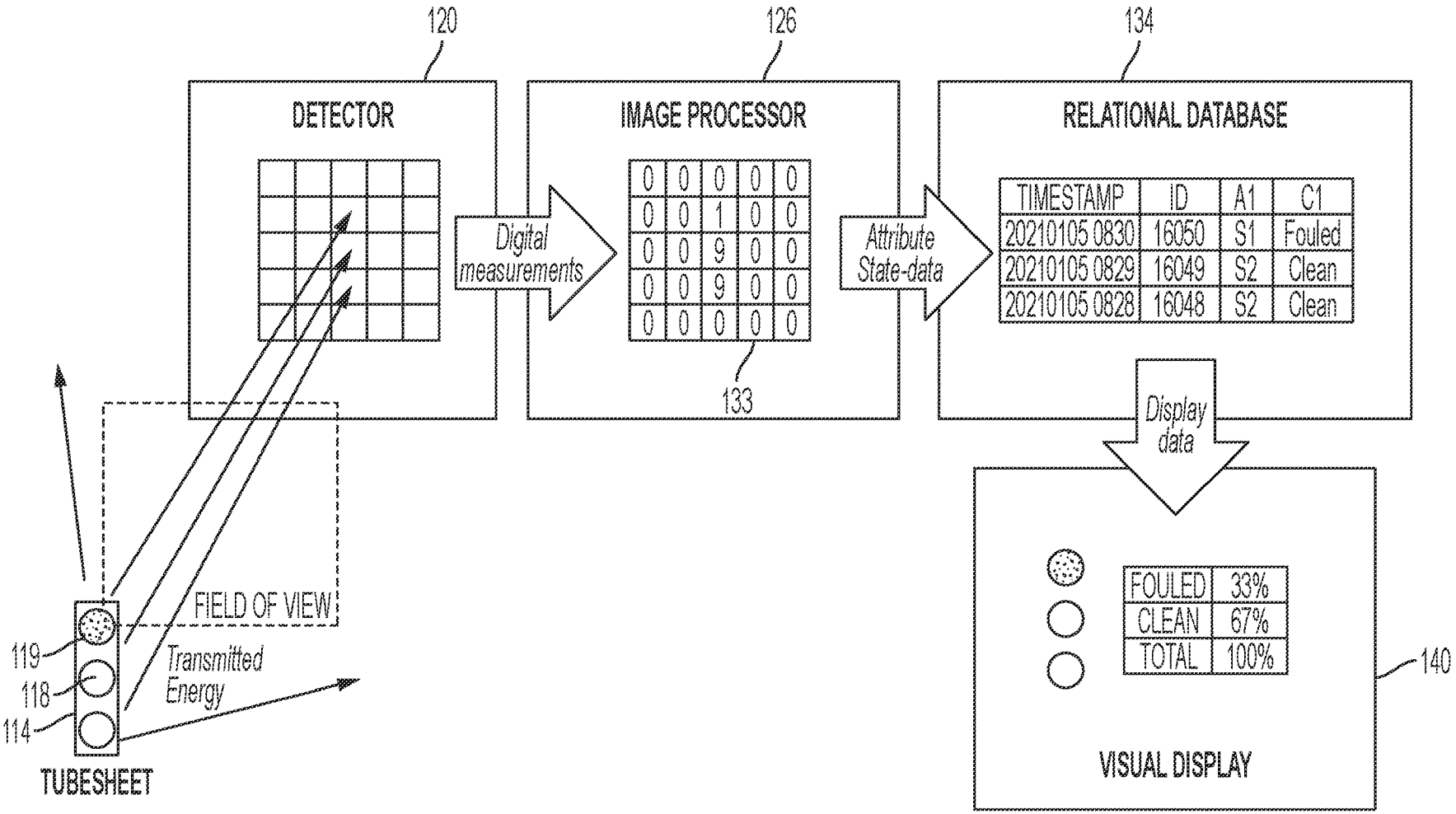
FIG. 6 depicts a schematic illustration of the image capture and data collection process.

Turning now to FIG. 6, one attribute that could be monitored in a routine is the intensity of the tube ends 119. More particularly, the region of the image within each tube end 119 is evaluated to determine if the tube end 119 is either "Dark" or "Light". This attribute can be used for example to evaluate the extent of coke accumulations in the tube ends 119. If significant black coke has accumulated at the inlet of a tube, this will appear as a "dark" region within the image of the tube end 119 (see the topmost tube end 119 in FIG. 6). The dark regions indicate that the tube 118 requires cleaning or other maintenance. Alternatively, minimal coke accumulation would result in a tube where white inert pellets are still visible, and so would appear as a "light" region within the image of the tube end 119 (see the lower two tube ends 119 in FIG. 6). Thus, the intensity attribute has two possible states, namely, dark or light.

In the example shown in FIG. 6, light energy reflecting from three tube ends 119 is collected by the Imaging Device 120 within the field of view (FOV) of its photodetector. The photodetector measures the intensity of energy reaching it, representing individual sensor measurements as digital values. Imaging Device 120 transmits those measurements to the image processor 126. Within the processor 126, a collection of related digital measurement values known herein as a digital image 133 are stored together as an array. The term "Digital Image," as used for the purposes of describing FIG. 6, differs from the conventional-use of the term, i.e., a photograph from a digital camera, or an image on a computer monitor, which are herein referred to as "Visual Images." The digital image 133, which cannot be seen with the human eye, exists only within electronic data systems. Data visualization software must be used to convert digital image 133 data into a format appropriate for rendering as a visual image [meaning a picture] on a display. In addition to visual images, data visualization software may also be used to present digital image data in one or more summary formats, such as a table, graph, spreadsheet, or color-coded summary graphic.

Mathematical operations (known generally as "image processing") are performed on the data to provide derivative digital images, assess image content (e.g., object is detected within the FOV), and compare multiple digital images in order to identify changes in object attributes. It is noted that some image processing could be performed within the circuitry of the Imaging Device 120 to speed up processing and reduce the amount of data to be transmitted to the processor 126 (and hence the bandwidth required).

The processor 126 determines states for the object attributes ("A1"). The attribute of interest in FIG. 6 is "darkness". State 1 (51)=Dark, with intensity measurements from 0 to 4 and, State 2 (S2)=Light, with intensity measurements from 5 to 9. Thus, states represent a range of measurements, or more specifically, a central value with a tolerance. Further details in connection with image processing are provided in the Examples section.

State-data is then transferred to the relational database 134 for storage and analysis. The relational database 134 maps attribute states (A1) to condition values (C1). For example, State 1 (S1) maps to the condition "Fouled" and State 2 (S2) maps to the condition "Clean." The relational database 134 software calculates performance metrics for the activity (e.g., % complete, number out-of-spec, predicted completion time, time stamp, tube identification "ID").

The performance metrics are (optionally) transferred to visual display 140 (such as a digital computer monitor or a printer) for real-time reporting. Data visualization software may also be used to render a visual representation of measurements within the digital image.

Another attribute that could be monitored in a different routine is the "texture" of the tube ends 119. A "smooth texture" state indicates that no pellets are present in the tube ends, whereas a "rough texture" indicates that pellets are present in the tube ends. This attribute data could be used to verify that all of the tubes have been properly loaded to the top with inert ceramic balls, for example, as intended.

The above processes and steps may occur while the device 110 is in operation. In one such embodiment, a digital camera may be positioned external to the shell and tube device in order to acquire one or more digital images of the tube sheet surface through an appropriately-designed sight glass.

In yet another routine, the system 100 can be used to monitor and track maintenance activities performed unto device 110. More particularly, during the process of maintaining the device 110, operators can position colored caps (yellow, green, red, etc.) over the inspected tube ends 119. The cap may also be referred to herein as a marker. Each color is used to indicate a different condition of the tube 118, e.g., "contains catalyst", "empty", or "cleaned". If the operator identifies that a tube 118 is clean, for example, then the operator will apply a red cap over the tube end 119 of that clean tube 118.

Once the caps are applied to the tube ends 119, the Imaging Device 120 is used to collect or acquire an image of the capped tube ends 119. The image processing software 132 is then configured to determine which one of the possible color-state options applies to the geometric regions of interest that correspond to each tube end 119.

To address the possibility of any obstructed tube ends 119, such as when an operator's tool bucket is sitting upon the tube sheet 114 and covering a group of tubes, one or more "universal" error-states might optionally be utilized with the present method—for example, State "U" may be optionally reserved to represent the condition "Unknown" and may be assigned to any circular tube end 119 that cannot be detected within the digital image. When the obstruction is later removed and the circular tube end may again be detected, the current state can then be assessed and recorded. In an alternative embodiment, obstructed tube ends may be addressed by implementing a "hold-last" strategy—that is, recording the last known state value each time a digital image is processed, until such time as the obstruction is removed. Such an approach may further include a corresponding note in the relational database 134 for that group of tubes, indicating that their state is "assumed." Optionally, when detection-errors occur, such as the aforementioned obstruction of tubes by a tool bucket, a visual or audible alarm may be initiated which directs the operator to take corrective action—for example, an Alert Message directing the operator to remove the obstructing object(s).

A key benefit of the using the colored caps is that it is possible to use the combination of time-stamp and attribute data within the relational database 134 to compare states within successive images and to determine the time(s) when state-changes occur. Changes in the state of an attribute are herein referred to as attribute "behavior." For example, the color behavior (change of color-state) of the tube ends 119 can be assessed over a specific time period in order to determine when the inspection of a tube 118 was completed, as well as to determine the outcome (tube condition) of that inspection. The identified color behavior might therefore be a change from "no cap" to "green cap" at a specific time (e.g., 9 AM), signaling the point in time when the tube 118 was determined to pass mechanical inspection (i.e., the specific time coming from the image time-stamp).

Using the relational database 134 software to evaluate color behavior of all tubes during a specific time period, it is possible to (i) generate behavioral metrics, such as "number of tubes inspected per hour" or "percent of tubes passing inspection," and (ii) predict future behavior, such as the remaining time to complete the inspection activity.

Furthermore, by assessing all of the tubes in this manner, the overall condition of the tube sheet 114 at the end of the activity (e.g., 98% of tubes passed inspection) can be determined, and a database record of that result can be created for future reference.

The colored caps can be used for other purposes. In another embodiment, the tracking of color behavior could be used to monitor progress toward completion of a dP (pressure drop) measurement task, such as described in Example 2.

Figure 4:
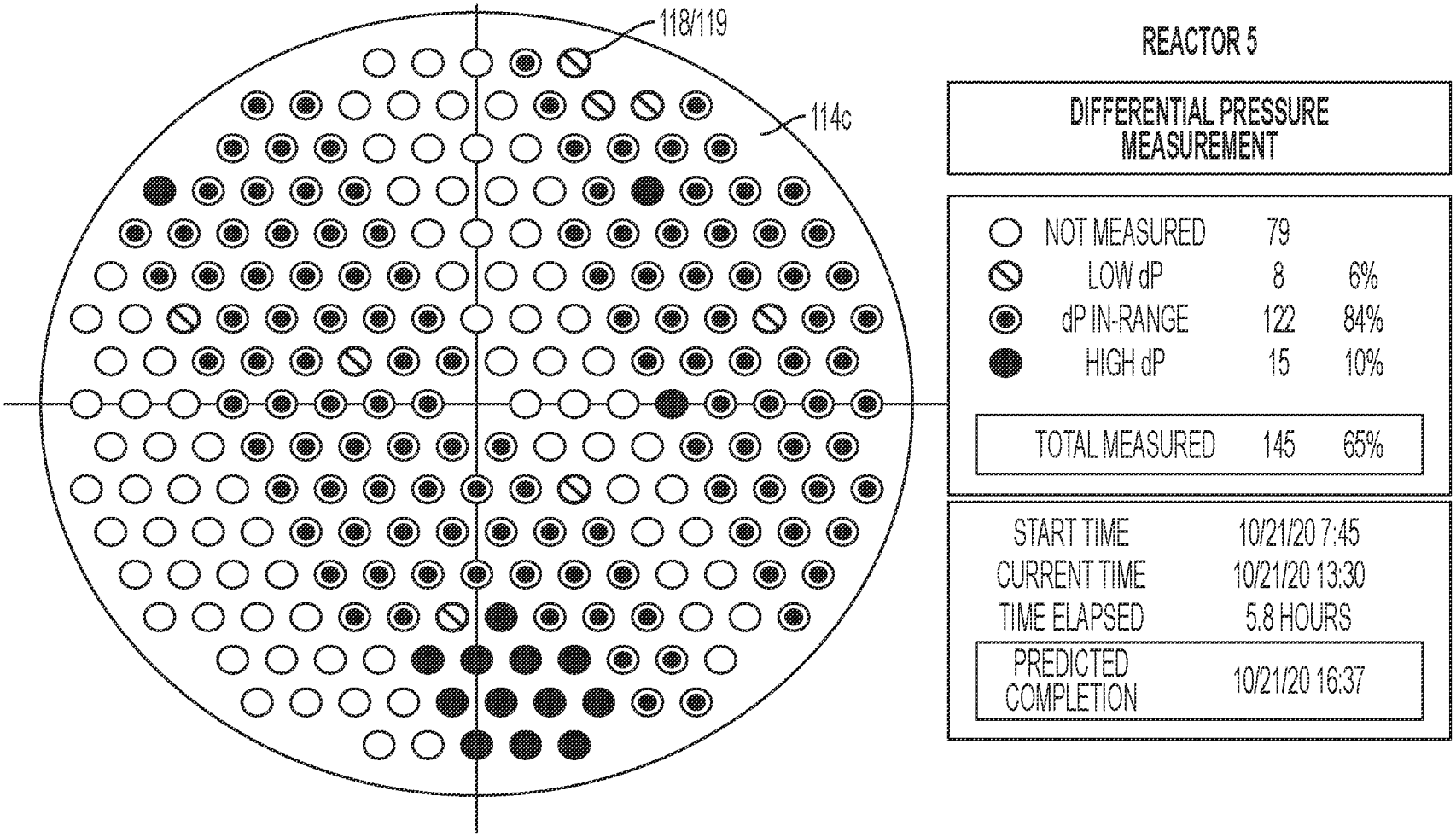
FIG. 4 depicts a visualization of the differential pressure measurements taken (or not) at each tube of the heat exchanger of FIG. 3A.

Turning now to FIG. 4, the system 100 may be used as a real-time display interface that is capable of communicating the state of each tube 118 at a specific time via the display 140. Visualized on the display 140 are the differential pressure measurements performed on each tube 118 of the tube sheet 114*c* of heat exchanger 300 (for example). The display interface may include a representation of the tube sheet 114 using symbols or colors. The display interface may optionally include key performance metrics, such as pressure measurements, percent of tubes inspected or the like, which are calculated using data records from the relational database 134. The display interface might also include access to related information from the relational database 134, such as the device name or a description of the task being performed.

Additionally, it may be beneficial to provide one or more portable display devices to operators within the reactor, so that they can monitor the state of tubes within the reactor during job execution. For example, workers performing fish taping from a position below the lower tube sheet may benefit from the capability to monitor, in real-time, the behavior of the tube ends within the upper tube sheet. If used, it is preferred that such display devices are configured as wireless (Wifi) display devices. It is also preferred that the display devices utilize touch-screen capabilities for ease-of-use in the field.

Additional, time-stamped reactor data may be stored in the relational database 134 along with the tube data. Examples include the temperature, humidity, and O2 concentration inside the reactor head.

Figure 5:
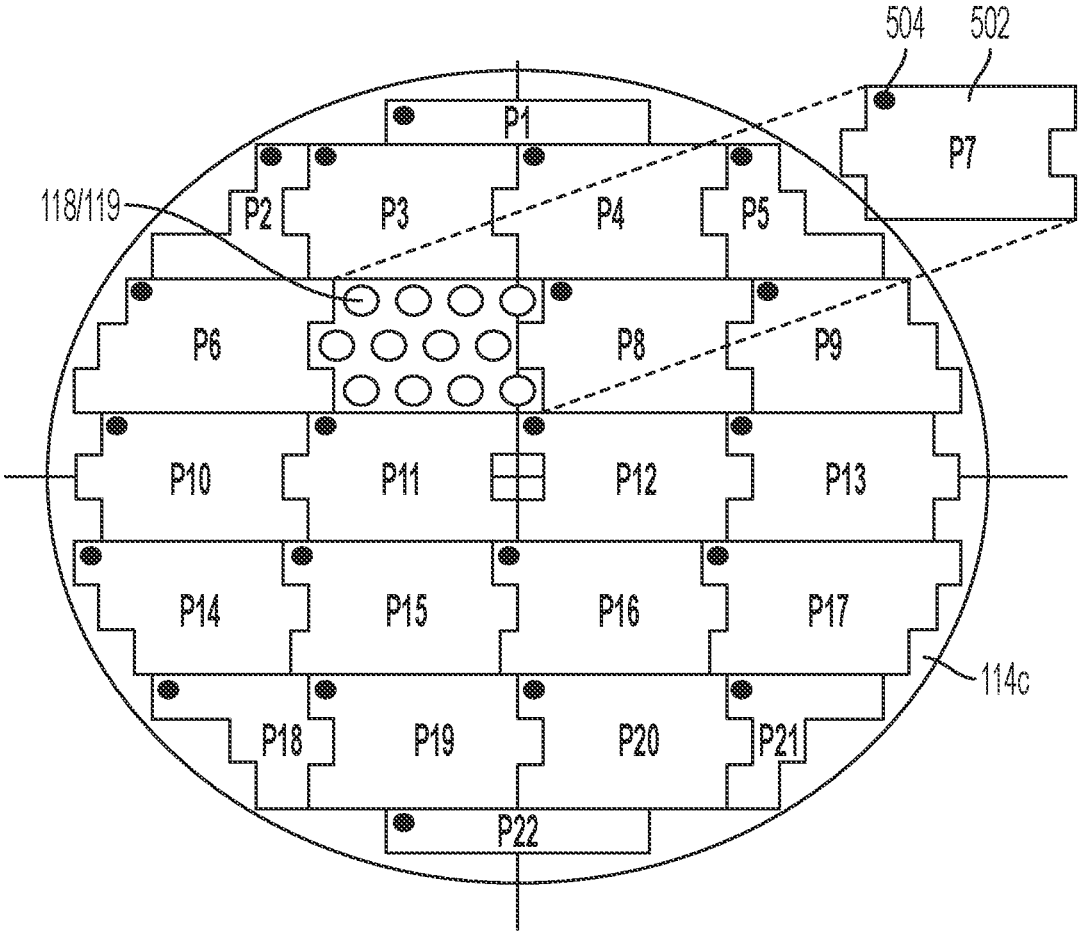
FIG. 5 depicts plugging plates applied to the tube sheet of the heat exchanger of FIG. 3A.

Turning now to FIG. 5, once an operator has performed a particular task (e.g., catalyst filling) on a group of tubes 118, the operator can position a plugging plate 502 over that group of tubes. The plugging plates 502 fit together like puzzle pieces, in a grid-like pattern. Such plates are described in US Patent Appl. Pub. No. 2016/220974 (US '974 hereinafter), which is incorporated by reference herein in its entirety. US '974 teaches using colored plugging plates wherein the color of each plate indicates the collective condition of all of the tubes located beneath that plate.

FIG. 5 depicts a series of plugging plates 502 (twenty two shown labeled P1-P22) applied over different groupings of tubes 118 of the tube plate 114*c* of the heat exchanger 300. A removable colored marker 504 is applied to each plugging plate 502. In use, the tubes 118 of a particular group are maintained by an operator, and the plugging plate 502 is manually applied over that group of tubes 118 by the operator to signify that a particular task is complete (e.g., loading of catalyst into the tubes beneath the plugging plate 502). The color (or lack of) the marker 504 on that plate 502 is indicative of a condition or state of those tubes. For example, a lack of a marker could indicate that the tubes beneath the plate are not yet loaded with catalyst material, and a black marker could indicate that the tubes beneath the plate 502 are filled with catalyst material. The operator selects the appropriate removable marker 504 for positioning on the plate 502. The Imaging Device 120 continuously monitors the color of the markers 504, like the color of the above-described caps, to determine the progress of a particular task, e.g., catalyst loading. As an alternative to tracking color differences between the markers 504, the shape of the markers 504 could also vary. The Imaging Device 120 can track the boundaries of each plate 502, and therefore know which tubes 118 are positioned beneath the respective plates 502.

(F) Enemy Transmission

The detection of visible light energy has been described thus far, however, the general concepts described above apply to all forms of energy transmission (e.g., light, heat, pressure, sound, x-rays, radio waves, electron beams) and their appropriate purpose-specific detectors.

If the energy is light reflected off the surface of the object (e.g., wavelengths of light selected from one or more of the visible light spectrum, the infrared spectrum, or the ultraviolet (UV) spectrum), a photodetector array (e.g., a Silicon-based CMOS photodetector, comprising an array of individual sensors known as pixels) can be used to measure the intensity of light at said one or more wavelengths and to create a monochromatic (grayscale color) digital image or an "RGB" color digital image. Using appropriate Data Visualization software (e.g., software known as display drivers), the color data may be optionally rendered as a visual image on a display device.

The source of the reflected light may be from the environment (e.g., sunlight)—known as passive illumination—or the light may emanate from an artificial white light source (e.g., a lamp)—known as active illumination. The light source may emit wavelengths of light within one or more of a visible light spectrum, an infrared (IR) spectrum, or an ultraviolet (UV) spectrum.

If the energy is thermal energy emitted from the object (e.g., IR radiation at wavelengths of between 7.5-14 μm), a thermal Imaging Device 120, comprising sensors known as bolometers, can be used to create a digital image comprising temperature values. Using appropriate Data Visualization software, the temperature data may be optionally rendered as a thermographic (visual) image on display device 140. Note that the infrared energy is emitted/radiated from the object, so there is no illumination source per se.

If the energy is reflected radio waves (e.g., from a radar system), the resulting digital image comprises radio signal return-time values that represent the distance between a point on the object and the radio-wave detector (receiver). When used with the inventive method, radar operating in the EHF band (also known as millimeter-wave radar) is preferred. Image acquisition systems based upon Radar, Sonar, Lidar, and the like are known herein as Non-contact Ranging Devices (NRD's), which generally "paint" the surface of an object with a moving energy beam in order to collect a large number of closely-spaced return-time (distance) measurements. Using (complex) Data Visualization software, this distance data can optionally be rendered as a visual image on display device 140 (e.g., weather-radar displays or lidar topographical maps). By their nature, NRD's require active "illumination" with energy that can then be reflected back.

(G) Imaging Device Details

Further details of Imaging Device 120 are described hereinafter. The Imaging Device 120 can comprises a detector, such as a photodetector or a thermal detector. A photodetector further comprises a plurality of light sensors, known as picture elements or "pixels". Similarly, a thermal detector comprises a plurality of heat sensors, known as microbolometers or simply, bolometers.

The most common and preferred embodiment incorporates optical imaging. In the optical imaging embodiment, an imaging device comprising a photodetector and an image processing software package are used for imaging with visible light. Imaging Device 120 may be a digital camera, an RGB color video camera, or a black and white camera, for example. Optics, i.e., lenses, focus light on a photodetector located within the focal plane of the camera (this is the so-called Focal Plane Array or FPA) to obtain images with minimal distortion (i.e., in-focus images). The individual sensors within the photodetector, (i.e., pixels), convert light contacting the photodetector into a digital signal. The digital signals are then transmitted to the image processor, wherein a digital image of the combined digital signal data is represented as a mathematical array.

When a digital image of the tube sheet 114 is acquired, it may comprise many thousands, or even millions, of digital values, depending on the detector array used. For example, a typical "4K" color digital Camera will comprise a CMOS photodetector array having 3840 horizontal pixels by 2160 vertical pixels, resulting in 8,294,400 distinct color measurements; this is generally referred to in the art as an "eight-megapixel array" or simply an "8 MP" detector.

As known in the art of digital imaging, optics and detector size control how much of the physical world can be "seen" by the Imaging Device, a term known as the Field Of View (FOV). Detectors are commonly configured as a fixed array (grid) of individual detection elements, with larger numbers of detection elements supporting a wider field of view and/or greater resolution. Most commercial photodetectors are implemented as a flat array built upon silicon wafers, which means that the maximum physical size of available silicon wafers limits the total number of detection elements possible; once the maximum array size is reached, only the selection of the lens(es) can impact Imaging Device resolution and the width of the field of view (FOV).

By convention, camera lenses are typically described by their horizontal FOV angle and their vertical FOV angle, while photodetectors are typically described by the number of pixels in the horizontal and vertical dimensions of the detector array. Because there are a fixed number of picture elements (pixels) in a given photodetector, the FOV and image resolution are inversely related, i.e., a wider FOV (more image area seen by the detector) results in a lower resolution, whereas a narrower FOV (more pixels per unit of image area) results in a higher resolution. Selection of an appropriate detector size (i.e., total number of pixels) and an appropriate lens FOV is within the ability of one of ordinary skill in the art of digital imaging.

As one example, if it is necessary to identify (i.e., resolve) 6 mm spherical catalyst pellets within an image, one skilled in the art might choose to represent each 2 mm×2 mm area with 1 pixel, such that the image of a single 6 mm sphere can then be fully represented by a single 3×3 pixel array (9 total pixels). This is known as 500 Pixels-per-meter (PPM) resolution. If the detector array used for image acquisition measures 2560 horizontal pixels×1440 vertical pixels, then the maximum FOV at 500 PPM resolution would be 5120 mm×2880 mm (16.8 ft×9.6 ft). Complimentary optics would then be selected with appropriate FOV angles to provide a clear image of this area upon the Focal Plane Array.

In some embodiments, multiple detectors may be physically "butted" together to create a multi-element Imaging Device that has an increased number of detection elements, in support of an expanded Field Of View. Such an approach is known in the field of astronomy, for example, to create wide-field digital telescopes. Unfortunately, such mechanically-joined detectors are currently very expensive and difficult to assemble. It is therefore preferred to acquire views of multiple, different regions on the tube sheet surface and then utilize image processing software to combine this collection of views into a larger, merged "mosaic" digital image, as is known in the art. Using image processing software, there is theoretically no limit to the size of a given mosaic digital image array. Acquisition of multiple images can be performed for example with multiple cameras, each having independent FOV's, or with a single camera that changes position—for example, a Pan-Tilt-Zoom "PTZ" camera.

Turning now to the instant invention, a single Imaging Device may be used, such as the aforementioned 8 megapixel (8 MP) video camera. The Imaging Device 120 may be positioned directly above the center of the tube sheet, for example, having been inserted through a top nozzle on the head of the shell and tube device.

For large tube sheets combined with relatively short heads, it may become difficult to capture the complete tube sheet surface within a single camera's Field of View (FOV). This is made more difficult because most photodetector arrays typically utilize a 3:4 or 16:9 aspect ratio, resulting in a different horizontal FOV vs vertical FOV, further limiting the area that may be imaged.

Thus, multiple Imaging Devices 120*a* and 120*b* may also be used with the instant invention. The Imaging Devices may be mounted, for example, against the interior wall of the vessel upon adjustable support posts. Additionally, they may be placed on opposite sides of the upper tubesheet, facing inward, and positioned about six feet above the plane of the tube sheet.

Alternatively, multiple imaging devices may mounted at the center of the vessel, facing outward. For example, four outward-facing imaging devices may be suspended above the center of the upper tubesheet, placed 90-degrees apart and positioned at a downward-facing angle of between about 15-degrees and 75-degrees relative to the plane of the tubesheet. Such a configuration may be used, for example, in shell-and-tube reactors having an annular tubesheet layout, wherein a circular region at the center of the tubesheet comprises no tubes. For reference, an example of a tubesheet with an annular layout is depicted in FIG. 1*c* of U.S. Pat. No. 9,440,903.

The accuracy of the tube identification step and the assessment of each tube's state can also be improved through the use of multiple views of the same tube sheet region. For example, two or more cameras may be used, each collecting image data of the same tube sheet region from different viewing angles. The Image Processing software may then be used to "integrate" the image data from these multiple views, replacing data in an obscured view with data from an alternate, unobscured view. In this way, obstructions, such as a person standing in front of the camera, may be addressed and a complete digital image may be obtained. Ultimately, as long as at least one camera can detect each tube, the state of every tube can always be tracked.

In a preferred embodiment, at least one RGB-D Camera is used to collect image data. An RGB-D Camera is a hybrid imaging device comprising both an RGB photodetector and a (LiDAR) laser detector, wherein these two detectors are internally synchronized to collect image data at the same time. Processing the synchronized image data produces so-called "Color 3D" images, which comprise both RGB color data and Depth data. The Intel® Realsense™ L515 LiDAR Camera (available from Intel Corporation of Santa Clara, California USA), which comprises both a 2 MP RGB photodetector and a laser detector operating at 860 nm, is one example of a commercially-available RGB-D Camera that is suitable for use with the present monitoring method. When a portion of an image becomes obstructed—for example, when the aforementioned person walks into the camera's field of view—it may be assessed by a single photodetector as a change in the state of one or more tubes, such as for example a change in the color of the tube ends. However, when a RGB-D Camera is used to collect image data, both tube end color and depth data can be assessed simultaneously. Changes in image depth data will indicate the presence of one or more obstructing objects between the camera and the tubesheet. Once detected, steps may then be taken to compensate for the presence of the obstructions, such as using alternative views (provided for example, by additional RGB-D Cameras), recording an error-code in the relational database, pausing image processing, or sounding an "obstructing object" alarm.

When multiple cameras are used, optional tube sheet benchmarks may provide a common reference point for camera alignment. These might be, for example, temporary magnetic markers or permanent marks.

Still-image digital cameras may be used to acquire optical images, but video cameras are often easier to configure for use with a networked computer. Commercially available video cameras are typically constructed with the built-in capability to transfer image data to an image processor (e.g., laptop computer) via wifi, LAN/PoE (Power over Ethernet) wiring, fiber optics, etc. In some embodiments, at least a portion of the image processing may be performed within the circuitry of the camera to speed up processing/reduce the amount of data to be transmitted (and hence lower the bandwidth requirement).

Most video cameras provide a continuous stream of 30 or more images per second. For the present inventive method, such a high rate of image acquisition is typically far more than is needed. In general, to monitor most maintenance activities, it is sufficient to acquire individual images at a slower rate, such as one image every 30 seconds, or one image per five minutes, or even one image per hour. Alternatively, a continuous stream of digital images may be acquired (e.g., 30 frames per second), however, the image processing software may be configured such that only a portion of this digital image stream is actually processed—for example, in one embodiment, image processing may be performed using just one image (frame) every fifteen minutes.

(H) Software Details

Software code to perform the image-processing steps described herein may be written using a variety of computer programming languages, for example, using C++, Python, or MATLAB programming languages. The image-processing steps employed may include one or more techniques widely known in the art of digital image processing, such as filtering, conversion of pixels between color and grayscale, (Canny algorithm) edge detection, Circle Hough Transforms, conversion of image data from one color model to another (e.g., RGB to L*a*b*), creation of image masks, and color detection. Libraries of standardized functions to efficiently perform these image-processing steps have been created and are currently available for incorporation into programming code, greatly simplifying the preparation of software routines. OpenCV (*Open Source Computer Vision Library*: http://opencv.org) is one such library of image-processing functions, which at present is available for download as open-source software. Although initially written under the C++ programming language, so-called "wrappers" are now available to allow functions in OpenCV to be used with other programming languages, such as Python, JAVA, and MATLAB. Proprietary applications such as IMAGE PROCESSING TOOLBOX™ and COMPUTER VISION TOOLBOX™ (commercially available from The Math Works, Inc of Natick, Massachusetts, USA) may be used to implement image-processing described herein. OpenCV adapted for use with the Python language (also known as OpenCV-Python) may also be used for image processing. Enhancements to Python, known as the "Numerical Python extensions" or "NumPy", may also be utilized to improve the performance of mathematical operations with array data.

Image processing software, such as Matlab and OpenCV, can perform operations using many different color models. As is known in the art, "Color models" are abstract mathematical representations of colors using ordered lists of parameters, referred to herein as "Channels." Images can be represented in many different formats, corresponding with well-known color models including RGB, HSV, and L*a*b*. Colors represented in the RGB color model specify the intensity of each of the three channels: R (Red), G (Green) and B (Blue) using values ranging from 0 to 255. RGB is the native format for devices such as video cameras and televisions. Colors represented in the HSV color model specify the following three channels: Hue, representing the dominant wavelength; Saturation, representing shades of color; and Value: representing Intensity. Colors represented in the L*a*b* color model specify the following three channels: L*, representing perceptual lightness or Luminosity; a*, representing the colors on an axis ranging between red and green; and b* representing the colors on an axis ranging between yellow and blue.

In contrast to full color images, Grayscale images contain only a single channel representing shades of gray. Pixel intensities in this color space are represented by values ranging from 0 to 255, with black being the weakest intensity (value of 0) and white being the strongest intensity (value of 255). Thus, the maximum number of states that can be represented by a single pixel in grayscale is 256. With only a single channel, image processing in Grayscale, rather than in full color, can be much faster and require fewer computing resources.

Image processing software further includes color-conversion algorithms, such that images acquired under one color model (e.g., an RGB image from a video camera) can be converted to a different color model. Such conversions are typically performed to simplify processing calculations or to highlight certain features within a Region Of Interest (ROI). Additionally, conversion algorithms allow color digital images to be converted to grayscale; which is often advantageous when searching for areas of high-contrast that typically occur along the edge of objects, and which is a key aspect of object-detection algorithms.

(I) EXAMPLES

Example 1: Skimming Tubes

The vertical shell-and-tube reactor of this example is the second reaction stage of a two-stage Tandem Reactor system and is used to convert acrolein to Acrylic Acid. The reactor comprises a tubesheet of about 7 m (23 ft) in diameter and more than 24,000 catalyst-containing tubes of 27.2 mm internal diameter. The inlet portion of each of these second reaction stage tubes contains a 35 cm deep top inert layer comprising 5 mm spherical ceramic pellets. This material is bright white in color when first loaded into the tubes and so has a high luminosity. Over time, carbonaceous deposits (aka "coke") accumulate within this inert media layer, causing it to turn a brown or black color and reducing its luminosity. Typically, the accumulation of deposits is uneven, with some reactor tubes being more significantly fouled than others. As the extent of fouling increases, flow through the tubes becomes restricted, thereby increasing pressure drop through the reactor and diminishing reactor performance.

To address this problem, the reactor is shutdown to replace the fouled inert media in at least a portion of the tubes with clean inert media, which is a maintenance activity known as "Skimming". This maintenance activity involves two multi-step tasks:

1) removal of the inert pellets from all significantly-fouled tubes using one or more methods such as vacuuming, chipping, grinding, and drilling; and
2) loading new, clean inert pellets into any tubes that do not have a complete top inert layer.

Prior to the start of the maintenance activity, the initial step of assigning a unique identifier to all circular tube ends was performed.

In some embodiments, this initial step might be performed manually by acquiring a visible light reference-image and rendering it on a laptop computer using "Image Viewer" software, (commercially available from The Mathworks Inc., Natick, MA 01760—USA). A key feature of Image Viewer is its ability to display user-selected individual pixel location-values and their associated color/intensity values. This allows for manual identification of the specific pixels that fall within each tube end, thereby providing a method for correlating groups of pixels with the appropriate unique tube identifier. This approach is most beneficial when the shell-and-tube device comprises a relatively small number of tubes.

In the embodiment of this example, however, this step was performed using the software 132 of the computer 124. A visible light reference-image was acquired and read into image processing software in grayscale format. The edges of all of the geometric regions of interest (i.e., the circular tube ends) were then identified within the image array. This may be performed, for example, by using the "Canny edge detection" algorithm, or the "Circle Hough Transform (CHT)" algorithm, both of which are well known in the art and available within OpenCV or Matlab software. In a preferred embodiment, the Circle Hough Transform (CHT) algorithm is applied to locate the circumferential edge of the circular tube ends appearing within the image. For example, in OpenCV, the "HoughCircles" function utilizes the CHT algorithm to detect all circles within an image, and provides both the location of the pixels that define the circle's circumference as well as the pixel-location of each circle's center. In this way, a complete list of all circle-center locations appearing in the image can be obtained. The pixel location coordinates (x, y) of each circle-center in the image array are then aligned with actual tube sheet dimensional data, in order to map the unique tube identifier to each circle-center.

It should be noted that only about ⅓ of the tubesheet area of a typical shell-and-tube device actually comprises holes (tube ends), while the remaining approximately ⅔ of the tubesheet area comprises only the planar surface between the tube ends. Thus, only about ⅓ of the Imaging Device data represents measurements from within the so-called Region Of Interest (ROI) on the tubesheet. By knowing the locations of all of the tube ends within the image, subsequent processing may be limited to just these circular ROI's, significantly reducing the time to evaluate each digital image. Those of ordinary skill in the art of image processing will recognize that image "masks" may be created using image processing software and then beneficially applied to achieve such optimized image processing.

In this example, the luminosity of the tube ends was selected as the Attribute to be assessed during this skimming activity. This selected Attribute is defined to have three States (as indicated in Table 1, below).

An Initial Digital Image of the tubesheet was acquired at Time Ti to memorialize the condition of the tubesheet at the start of the Maintenance Activity. Although a camera comprising a monochromatic or Grayscale photodetector may suffice for this task, in this example, a digital camera comprising an RGB (visible light spectrum) photodetector was used to collect color measurement data from the tubesheet.

The resulting initial Digital Image (Di) of the tubesheet was then transferred from the camera to the Image Processor. Using OpenCV Image processing software, the RGB pixel data in the initial Digital Image was converted to grayscale, removing the channels related to hue; this effectively reduces the color measurements to an array of luminosity values ranging between 0 and 255, wherein 0 is the lowest value of luminosity, representing pure black; 255 is the highest value of luminosity, representing pure white; and the intermediate values between 1 and 254 represent various shades of gray. The Attribute State of each tube was then determined by assessing the average value of the grayscale pixels within each circular tube end and assigning one of the three State values in accordance with the appropriate range of average luminosity values:

TABLE 1

| Range of Luminosity Values | State | Tube Condition |
|---|---|---|
| 0-63 | 0 | FOULED |
| 64-191 | 1 | EMPTY |
| 192-255 | 2 | CLEAN |

Attribute State-data for each tube end was then transferred to the Relational Database wherein multi-field database records were created for each tube. The database records comprise: a timestamp representing the time (Ti) that the initial Digital Image (Di) was acquired; the unique tube identifier; and the assigned Attribute State value. Lookup tables within the Relational Database were used to map Attribute States to specific tube Conditions and these Conditions were included in each database record.

The relational database was then used to perform initial analysis and reporting on the tubesheet status—for example, determining the total number of Fouled vs. Clean tubes present at the start of the activity. Additionally, step-duration data may be used to predict time-to-completion for the Skimming activity. In this example, approximately 6,000 tubes were identified as being fouled and therefore requiring inert replacement; based upon a historical average clearing-time of 5 minutes per tube (a 5 minute step-duration) and an available team of ten workers (10 clearing steps performed simultaneously), the job was predicted to have a duration of approximately 50 hours.

Once the Maintenance activity had begun, the status of the tubesheet was monitored by acquiring an additional Digital Image of the tubesheet every 10 minutes. During each 10-minute interval, approximately 20 clearing steps were performed. As with the initial Digital Image, the Image Processor converted the later images to grayscale and assessed the Attribute State of each tube end. The Relational Database was then used to record and regularly report the condition of the tubes within the tubesheet. In this way, tubesheet monitoring continued until the Maintenance activity was completed.

Although this specific example illustrates the application of the present method to a shell-and-tube chemical reactor, one of ordinary skill in the art could easily envision a similar approach being applied to other shell-and-tube devices, such as for example the assessment of luminosity in the tube ends of a multi-pass horizontal heat exchanger during the removal of mineral scale or polymeric solids.

Example 2: Measuring Pressure Drop

In a two-stage SSOI type shell-and-tube reactor, a new catalyst charge was loaded into the tubes of the lower reaction stage. This stage of the reactor comprised a 6,430 mm (20.9 ft) diameter circular tube sheet, as well as 22,000 seamless carbon steel tubes each with a total length of 3,750 mm (12.3 ft). The tubes had an internal diameter of 25.4 mm (1 inch) and were arranged in a 60-degree triangular pattern, with a 38 mm (1.5 inch) pitch. Each of these tubes was loaded with a two-layer catalyst charge comprising: approximately 1 m (39 inches) of 7 mm×9 mm cylindrical catalyst pellets, and approximately 2.5 m (98 inches) of 5 mm×7 mm cylindrical catalyst pellets.

After loading all of the tubes within the lower reaction stage, it was necessary to assess the loading density of catalyst within each tube by measuring the differential pressure (dP) though each tube. It is common for the duration of this dP measurement activity to be 24 hours or more.

In the case of this example, the differential pressure (dP) measurement activity was performed using a plurality of air operated, back-pressure measurement devices. Single-tube and multiple-tube dP measurement devices of this type are well-known in the art of catalyst loading and various embodiments are described, for example in U.S. Pat. No. 6,694,802, as well as WO 02074428 (A2) and DE 3935636 A1, which are each incorporated by reference herein. The specific devices used in this example were single-tube dP wands, configured with a 0.0625 inch Flow Orifice and provided with a 60 psig dry air supply to assure sonic air flow was achieved for accurate measurements. The circular tube ends were temporarily color-coded during this dP measurement activity in order to clearly indicate which tubes did not meet the required pressure-drop specification and would therefore require corrective action.

The selected Attribute to be assessed during this Differential Pressure (dP) measurement Activity was the color of the tube ends; this Attribute was defined to have four color-States (as indicated in Table 2 below). One of ordinary skill in the art of catalyst loading will recognize that there are many different ways to temporarily impart color to the circular tube ends within a tube sheet.

For example, in one embodiment, a plurality of standard #5 size tapered laboratory stoppers may be inserted into the 25.4 mm diameter tube ends; these stoppers are a commodity material and can be readily purchased from laboratory supply companies in many different colors including red, green, black, white, and blue.

In another embodiment, hand-cut 25 mm×25 mm (1-inch×1-inch) squares of colored adhesive tape—such as for example pieces of Duck Tape® Brand Colored Duct Tape (commercially available as rolls in a variety of colors from Shurtape Technologies, LLC. of Avon, OH 44011—USA)—may be temporarily placed over the tube ends.

In another embodiment, a plurality of the tube marking devices disclosed in U.S. Pat. No. 8,063,778 may be installed in the tube ends.

In this example, a plurality of CAPLUGS™ T-Series tapered plugs (commercially available in multiple colors from Protective Industries, Inc of Buffalo, NY—USA) were used for marking the circular tube ends. It is preferred that uniformly-colored, commercially available plastic caps such as these are used in order to limit variability in cap hue/intensity. This simplifies the task of differentiating the specific color-states. As taught in U.S. Pat. No. 2,580,762 A, which is incorporated by reference herein, the geometry of these devices allows them to function as either a cap or as a plug. In industry, it is common to refer to them as simply "caps", a convention we will follow herein. In the case of this specific example, four distinct colors of model T-12X caps [Material Code: PE-LD01] were selected having the manufacturer's color designations: RED002, GRN002, BLU003, and YEL002 to provide the necessary four color states (see Table 2). It has been determined that these cap colors are easily differentiated by the Imaging Device 120 and image software 132.

Prior to the start of dP measurements, the initial step of assigning a unique identifier to all circular tube ends was performed. Additionally, Yellow T12-X CAPLUGS™ ("caps") were installed in the tube ends 119 of every unmeasured catalyst tube in the reactor.

A pair of Aida model #UHD-100A RGB digital cameras (commercially available from AIDA Imaging, Inc of West Covina, CA. 91797—USA (www.Aidaimaging.com)), herein referred to as Cam1 (e.g., Imaging Device 120*a*) and Cam2 (e.g., Imaging Device 120*b*), were placed proximate to the interior wall of the reactor head, on opposite sides of the tube sheet. Each camera comprises an 8 MP color photodetector measuring 4096 horizontal pixels×2160 vertical pixels, providing an Imaging Device resolution of 500 Pixels Per Meter (PPM); thus each pixel within the detector array represented a 2 mm×2 mm area of the tube sheet surface. Cam1 was positioned along the southern wall of the reactor head, such that its Field Of View comprised the half of the tube sheet surface that represents the Northern Hemisphere of the tube sheet; and Cam2 was positioned along the northern wall such that its Field Of View comprised the other half of the tube sheet surface representing the Southern Hemisphere of the tube sheet. An existing benchmark on the surface of the tube sheet, originally installed during shell-and-tube reactor fabrication, was conveniently used as a reference point for proper positioning of the two cameras.

An Initial Digital Image of the tubesheet was acquired from each of the cameras at the same Time (Ti) to memorialize the condition of the tubesheet at the start of the maintenance activity. The resulting pair of initial Digital Images was then transferred from the cameras to the Image Processor, wherein the image from Cam1 and the image from Cam2 were merged (for example, using software tools from the Python Data Analysis Library, pandas) to create a combined initial Digital Image of the complete tubesheet surface, comprising the color data for more than 16 million pixels. Using OpenCV image processing software, the RGB-format pixel data in the combined initial Digital Image was then converted to HSV color format for assessment. Next, an HSV-format color value was determined for each tube end, by calculating the average color value of a 7×7 (49 pixel) sample window positioned concentrically within each circular tube end. One of the four color States was then assigned to each tube end in accordance with the appropriate range of average HSV color values:

TABLE 2

| Range of average HSV Color Values | | | Attribute | |
|---|---|---|---|---|
| H | S | V | State | Tube Condition |
| 40-65 | 50-100 | 100 | YELLOW | UNMEASURED |
| 85-140 | 100 | 50-100 | GREEN | IN-SPECIFICATION |
| 0-15; 345-360 | 100 | 50-100 | RED | dP HIGH |
| 220-250 | 100 | 50-100 | BLUE | dP LOW |

In this example, SQL Server 2019 (from Microsoft Corp, Redmond, WA—USA) was the preferred Relational Database software. As in the case of this example, when OpenCV-python is utilized for image processing, the Microsoft "pymssql" driver may be used to facilitate transfer of color Attribute State-data for each tube end between the image processing software and the Relational Database. As in the previous example, multi-field database records were created for each tube, the records comprising: a timestamp representing the time (Ti) that the initial Digital Images were acquired; the unique tube identifier; and the assigned color State value. Lookup tables within the Relational Database were also used to map Attribute States to specific Tube Conditions and these conditions were also included in each database record.

The relational database was then used to perform initial analysis and reporting of the tube sheet status, for example, determining the total number of unmeasured tubes present at the start of the activity, which in this case was 22,000. This initial result was valuable in that it provided positive verification that all 22,000 tubes had been captured in the acquired images and that a yellow cap had in-fact been installed in every tube end.

The steps of the dP Measurement activity were then performed. Immediately before dP measurement of a tube, the yellow cap was removed. The end of the dP stick was placed into the tube end and a fixed flow of air was blown into the tube. The back-pressure created by the catalyst within the tube was shown on the dP stick's display for comparison to the acceptable dP value (+/− an allowable tolerance range). Optionally, the precise numerical dP value may also be electronically recorded. A new cap was immediately placed on the tube, with the color of the new cap indicating the dP measurement result. Green indicates acceptable dP (within the allowable tolerance range of 6.26 psig to 7.34 psig), red indicates unacceptably high dP (greater than 7.34 psig), and blue indicates unacceptably low dP (less than 6.26 psig). These steps were repeated on additional tubes 118 until all of the tubes on the tube sheet 114 have been measured and the associated tube ends 119 had been marked.

Once underway, the status of the tube sheet during this maintenance activity was monitored by concurrently acquiring further Digital Images of the tube sheet from Cam1 and Cam2 at 15-minute intervals. These digital images were also transferred to the Image Processor, wherein the color Attribute of each tube end 119 was assessed and the respective color State values were assigned. Because the ranges of Hue values ("H" in Table 2) for each State do not overlap, the "S" and "V" channels are not needed, and the "H" channel could be used exclusively as the criteria for assigning color-state values. As with the initial Digital Image, timestamped database records for each tube were continually added to the SQL Server relational database, allowing performance metrics to be continuously calculated, such as the total number of unmeasured tubes, the percentage of out-of-specification tubes, and the predicted time-to-completion for the activity.

Visual display software, including the Delphi graphical User Interface (UI) package (commercially available from Idera, inc of Houston, TX—USA), was used to query the SQL database and to generate a continuously-updating, interactive representation of the tubesheet (see FIG. 4) on a touch-screen computer monitor. In an alternative embodiment, the visual display may use colors that match the assigned color-states, rather than the (black and white) patterns shown in FIG. 4.

In this way, continuous tube sheet monitoring was performed until all tubes on the tube sheet had been measured and marked. At the completion of this dP measurement activity, 98.9% of the tubes were determined to fall within the allowable dP range, which indicated that uniform catalyst density had been achieved. Corrective measures were then undertaken in a separate activity to address those few tubes which fell outside of the allowable tolerance range (red/blue caps) for the dP specification.

This example illustrates that, by monitoring the color behavior of these tube ends 119, it is possible to track (i) the rate of completed measurements in real time, (ii) the number of remaining measurements to be made (% complete), and (iii) the number of out-of-tolerance tubes requiring correction. Such real-time monitoring would be very difficult to perform if one had to manually and repeatedly count each of the 22,000 of tubes within the reactor while the activity was underway.

Although this specific example describes the application of the inventive method to a shell-and-tube chemical reactor, there exist many other embodiments wherein tube end color could be used as the selected attribute for tracking maintenance activities for other shell-and-tube devices. For example, the method could be used to track the progress of a visual tube inspection for a large horizontally-oriented steam condenser in a Power Plant. Such condensers are known to experience tube side accumulations of minerals, such as calcium carbonate and magnesium silicate, that can greatly inhibit heat transfer. Microbiological fouling, which retards heat transfer and can induce severe under-deposit corrosion, may also be present. In this embodiment, three color states are defined (Green, White and Red) and the tube ends are temporarily colored by installing caps with a color equivalent to the defined State. Acquisition of digital images and image processing proceeds in generally the same way as was described in the preceding example, with the tube conditions that are mapped to these states being: green=clean tube; white=scale-only present; and red=biofilm present. The results of the inspection can not only be used to develop a cleaning activity plan, but can also provide valuable feedback on the performance of the current mineral scale and biological-growth inhibitor systems in use at the plant.

Example 3: Loading Catalyst

For the shell-and-tube reactor of this example, it was necessary to perform several different catalyst change activities, including but not limited to: used catalyst removal, tube cleaning, catalyst charging, and outage checking. Multi-tube catalyst charging is the specific Catalyst Change Activity of this example. The objective of this activity was to uniformly charge a 4,600 mm (15 feet) long layer of 5 mm diameter spherical particulate catalyst into each tube of the reactor.

The shell-and-tube reactor of this example had an upper horizontal tubesheet that is 5,517 mm (18.1 feet) in diameter and comprised more than 22,000 seamless carbon steel tubes. The tubes had an internal diameter of 22.3 mm (0.878") and were oriented vertically, with the upper end of each tube being attached by circumferential welds to the upper tube sheet. The tubes were arranged on the tube sheet in a 60-degree triangular pattern, with a 34 mm (1.34") tube sheet pitch. The top head of this reactor was removable, providing easy access to the upper horizontal tube sheet for performing maintenance activities. The removal of the top head allowed ambient lighting (passive illumination) to be used for image acquisition.

In this example, multi-tube catalyst charging was performed using a plurality of Multi-Tube Loaders (MTL's) of the type described in US Patent Application No. 2016/0220974 (A1), which is incorporated herein by reference. The highest-capacity MTL used in this example was capable of simultaneously charging 120 tubes with particulate catalyst. As taught in the US '974 application, a plurality of so-called tubesheet "Plugging Plates" 502, which are illustrated in FIG. 5, were used to orient the MTL's upon the tubesheet during the multi-tube Catalyst Charging Activity. While beneficial for the loading process, the use of these tubesheet plugging plates 502 generally obscured the circular tube ends. Thus, the status of the shell and tube reactor was determined through monitoring attributes of the plugging plates 502 themselves, rather than attributes of the individual tube ends 119.

Prior to the start of the multi-tube catalyst charging activity, more than 200 plugging plates (P1, P2, P3, . . . ) were placed upon the shell-and-tube reactor tubesheet, such that all of the circular tube ends were covered, creating a grid-like pattern of the type schematically represented in FIG. 5. It should be noted that FIG. 5 provides a simplified representation of the tube sheet of the Example 3, comprising only 224 tubes (118) and just 22 plugging plates (502).

As generally indicated in FIG. 5, multiple shapes and sizes of plugging plates may be used, resulting in different numbers of tube ends 119 being covered by each individual plate. Also, as taught in the US '974 application, the plugging plates may have different colors, with the selected color of each individual plugging plate being used as a control step for the charging activity. In an alternative example, all of the plugging plates may be a single color and the control step function may be performed by marking the top surface of the plugging plates—for example, using numbers, text, or symbols. Such markings may be a permanent feature of the plugging plates or they may be temporarily affixed to the plates' surface (using e.g., magnetic labels, adhesive tapes, dry-erase marking pens) in order to minimize the total number of plugging plates required.

In this example, each plugging plate 502 was fabricated from white, opaque (poly-methyl methacrylate) acrylic sheet having a 'P95' matte surface finish to minimize glare. Each plugging plate comprised a single circular recess 504 in its top surface, suitable for receiving a 38 mm (1.5 inch) diameter colored indicator disk. In some embodiments, it may be beneficial to permanently designate the outer circumference of each recess with optional high-contrast marking, such as for example, a black circle with a line-width of 3 mm (0.1 inch) or more. The recess may further comprise an optional, concentric through-hole with a diameter of less than 38 mm (for example, a 19 mm or 0.75 inch hole, not shown) to facilitate removal of the installed indicator disk. As illustrated in FIG. 5, the circular recess 504 is represented by a solid black circle in the left corner of each plate. While the specific location is not critical, it is preferred that the circular recess 504 be positioned in a consistent location on each plugging plate, such that image processing may be simplified.

The colored indicator disks are preferably also fabricated from matte, opaque acrylic sheet and are provided in a plurality of colors suitable for performing the control step function. In this example, the selected attribute to be assessed during this Multi-tube Catalyst charging activity was therefore the color of the indicator disk installed in each plugging plate, and this Attribute was defined to have four color-states (as indicated in Table 3 below). In this example, white indicator disks were initially installed in all plugging plates.

In this example, an OAK-1 digital camera (available from Luxonis Holding Corp of Westminster, CO—USA (www.store.opencv.ai)) was selected for image acquisition. The OAK-1 camera comprises a 12 megapixel (12 MP) Sony IMX378 CMOS color photodetector measuring 4056 horizontal pixels×3040 vertical pixels, capable of imaging the entire upper surface of the reactor tube sheet at a resolution of 500 Pixels Per Meter (PPM). Thus, each pixel within the detector array may represent a 2 mm×2 mm area of the tubesheet surface. The OAK-1 camera further comprises optics having a 81 degree Horizontal FOV and a 68.8 degree Vertical FOV. Using simple trigonometry, one of ordinary skill can determine that this camera should be positioned at a perpendicular distance of about 4030 mm (13.2 feet) above the geometric center of the tubesheet in order to image the entire tubesheet within the available FOV.

Prior to the start of the Maintenance Activity, a reference image of the plugging plates in position upon the tubesheet was acquired and the centerpoint of each colored indicator disk was located within the image array. The coordinates of each colored indicator disk center-point were then used to represent the location of each respective plugging plate in the image array and a unique identifier (represented in the Figure as P1, P2, P3, . . . etc) was assigned to each plugging plate at this centerpoint location. An image mask was also created to simplify further image processing.

An Initial Digital Image of the plugging plates was acquired at Time Ti to memorialize the condition of the reactor at the start of the catalyst charging Activity. The resulting initial Digital Image (Di) of the plugging plates was then transferred from the camera to the Image Processor in its native RGB-format.

It is noted that uncontrolled variations in ambient lighting conditions (passive illumination) can negatively affect the quality of digital images of the tubesheet, making image processing tasks such as edge detection more difficult. Under low-light conditions, the use of supplemental lighting (active illumination) may be beneficial. Conversely, under high-intensity lighting conditions, such as when portions of the tubesheet are exposed to full sunlight, some pixels within the photodetector may become saturated, losing their ability to properly measure color data. In such cases, repositioning the camera to obtain a different viewing angle of the tubesheet may resolve the problem.

In some embodiments, optical filters may be used in combination with camera lenses to enhance image quality during the acquisition step. For example, colored-glass photographic filters may be used to accentuate color differences, or polarizing filters may be used to reduce glare that might otherwise obscure image details.

In this example, the color digital image was first converted from RGB format to L*a*b* color format within the image processor using the OpenCV function cv2.BGR2LAB. Within the L*a*b* format, the intensity of the illumination is captured within the L* channel (luminosity value) while the a* and b* (chroma values) channels are relatively insensitive to illumination intensity. By utilizing only the a* and b* channels, it is therefore possible to obtain good differentiation of indicator disk colors under a wide range of tubesheet illumination.

Once in L*a*b*-format, color values were determined for each color indicator disk, by calculating the average color value of a 9×9 (81 pixel) sample window positioned concentrically over each colored indicator disk.

The color state of each plugging plate was then determined by assessing the average value of only the a* and b* color channels and assigning one of the four color state values, in accordance with the ranges of Table 3 below. Those of ordinary skill in the art of image processing will recognize that the formal color-model values for a* and b* can range from (−128) to (+128), but OpenCV instead uses Adjusted values ranging from 0 to 255. The conversion formulae appear at the bottom of Table 3 for reference.

TABLE 3

| Range of average L*a*b* Color Values | | Color | |
|---|---|---|---|
| Adj (a*) | Adj (b*) | State | Tube Condition |
| 112-144 | 112-144 | WHITE | Empty Tubes |
| 0-144 | 0-64 | BLUE | Charged/Not Verified |
| 0-64 | 160-255 | GREEN | Charged/Outage Verified |
| 192-255 | 178-255 | RED | Error/Correction Needed |

Note:
Adj (a*) = a* + 128 and Adj (b*) = b* + 128

Color-data for each plugging plate was then transferred to the Relational Database wherein multi-field database records were created for each plugging plate. The database recorded: a timestamp representing the time (Ti) that the initial Digital Image (Di) was acquired; the unique plugging plate identifier; and the assigned color State value. Lookup tables within the Relational Database were then used to map color States to specific Tube Conditions, and these Tube Conditions were also included in each database record.

Because plugging plates may cover different numbers of tubes, the relational database further comprises a lookup table of plugging plate size data. This data can be used to map the number of tube ends covered by each plugging plate to the unique identifier for that plugging plate. In this way, the accuracy of tube counts for each color state can be improved. Table 4 provides an example of such a lookup table for the tubesheet illustrated in FIG. 5.

TABLE 4

| Plugging Plate Unique Identifiers | Number of Tube Ends Covered |
|---|---|
| P1, P2, P21, P22 | 5 |
| P5, P18 | 6 |
| P9, P14 | 11 |
| P3, P4, P7, P8, P10, P11, P12, P13, P15, P16, P19, P20 | 12 |
| P6, P17 | 13 |

After acquiring and processing the initial image, the following steps of the catalyst charging activity were performed as follows:

a) Remove one of the plugging plates to expose circular tube ends below the plate
b) Position the multi-tube loader (MTL) over the exposed tube ends
c) Fill the MTL with catalyst
d) Charge the tubes with catalyst
e) Remove the MTL from the exposed tube ends
f) Change the colored indicator disk in the plugging plate
g) Replace the plate to cover the charged tubes And, after a period of time, but possibly while MTL's are still performing steps a) through g):

h) Remove one of the plates to expose the tube ends 119 of previously charged tubes below the plate
i) Verify/correct length of the catalyst layer in each tube, by addition or removal of catalyst particles
j) Change the colored indicator disk in the plate
k) Replace the plate to cover the verified tubes.

Once underway, the status of the tubesheet during this catalyst charging activity was monitored by acquiring a later Digital Image after each plugging plate replacement (i.e., each time steps g or k were completed). As previously described, these digital images were also transferred to the Image Processor, wherein the color of each indicator disk was assessed and the respective color State values were assigned. As with the initial Digital Image, timestamped database records for each plugging plate were continuously added to the Relational Database, allowing performance metrics to be continuously calculated, such as the total number of Charged tubes and the predicted time-to-completion for the activity.

Example 4: Installing Catalyst Retainers

In this example, the monitored activity was Catalyst Retainer Installation in the lower tube ends of a vertical shell- and tube reactor comprising 25.4 mm (1 inch) tubes. As is known in the art, a Catalyst Retainer is used to support the catalyst charge within each tube and each retainer must be installed at the same fixed vertical distance from the lower tubesheet. Achieving the correct elevation of the installed retainer is critical as it controls the length of all catalyst layers loaded thereafter.

FIG. 1E of U.S. Pat. No. 9,440,903, which is incorporated by reference herein, provides an illustration of the specific "Catalyst Clip" used as the catalyst retainer in this example, although it is envisioned that other catalyst retainers may also be employed. As is known in the art, specific tools are utilized to assist in the proper installation of these Catalyst Clips. However, with the many thousands of tubes present in a typical commercial shell-and-tube reactor, it is not uncommon for at least a portion of the catalyst clips to be installed at the wrong elevation or installed with an improper incline (i.e., not level). In some cases, no clip may be installed in a given tube, or the clip may become dislodged during the loading process.

In this example, it was desired that all of the catalyst clips be placed at an elevation of between 12.7 mm (0.50 inch) and 19.1 mm (0.75 inch) above the lower tube sheet. The selected Attribute to be assessed in this example was therefore the installation depth of the clips within the tube, as measured relative to the bottom, planar surface of the lower tube sheet. This attribute was defined to have four numerical States (as indicated in Table 5 below).

In this example, the selected imaging device was a Non-contact Ranging Device (NRD), rather than a digital camera. Specifically, the NRD is a LiDAR device comprising at least one laser operating at a wavelength of between 800 nm and 1600 nm. The commercially-available Density Entry Sensor (available from Density Inc. of San Francisco, CA—USA), which may be repurposed for use with the inventive method, is one example of such a LiDAR device. With the on-going development of NRD systems for use in autonomous vehicles, many excellent, low-cost LiDAR devices operating at wavelengths of 905 nm and 1550 nm are now commercially available.

In a preferred embodiment, Digital images may be acquired using at least one Velarray M1600 solid-state LiDAR device (available from Velodyne Lidar of San Jose, CA—USA). It is further preferred that MATLAB software, which includes a "velodynelidar" interface, be used for image processing and optionally, for visualization of associated point clouds.

As described in the previous examples, the tube ends were first assigned unique identifiers and then a digital image comprising the tube ends within the lower tubesheet was acquired.

In this example, the Imaging Device measurements were return-time values which were converted by the Image Processing software into the desired relative depth measurements. As will be apparent to one of ordinary skill in the art, measurements of the distance between the LiDAR device and the bottom surface of the lower tube sheet are also required in order to properly calculate relative installation depth.

Once calculated, relative installation depth measurements were then assessed in accordance with the ranges of Table 5 to determine Attribute State values. The relational database was then used to associate the appropriate Tube Condition with each Attribute State:

TABLE 5

| Range of Installation Depth Values | Attribute State | Tube Condition |
|---|---|---|
| 0-12.6 mm (0-0.496 inch) | −1 | Clip Too Low |
| 12.7-19.1 mm (0.50-0.75 inch) | 0 | Proper Installation |
| 19.2-50.8 mm (0.756-2.0 inch) | +1 | Clip too High |
| >50.8 mm (>2.0 inch) | +2 | Clip Missing |

After beginning the Catalyst Clip Installation activity, the status of the tube sheet was continuously monitored by acquiring and processing an additional Digital Image of the tube sheet every 5 minutes until the Catalyst Clip Installation activity was completed. In some embodiments, Visual display software may be used to present the collected LiDAR return-time data measurements as a so-called "Point Cloud" image on a video display screen, but this is not a requirement for the practice of the inventive method.

As with the initial Digital Image, timestamped database records for each lower tube end were continuously added to the Relational Database, allowing performance metrics to be calculated, such as the total number of Catalyst Clips installed and the predicted time-to-completion for the activity. Additionally, real-time monitoring of the installation activity allows prompt corrective action to be taken whenever it is determined that an improper installation technique is being used, avoiding many hours of undesirable rework.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for monitoring a status of a shell and tube device during a particulate catalyst loading activity, the shell and tube device comprising a tube sheet comprising a plurality of tube ends arranged in a fixed pattern of rows (R) and columns (C), said method comprising the steps of:

a) placing a plurality of plugging plates on said tube sheet such that all of the plurality of tube ends are covered, each of the plurality of plugging plates comprising a disk recess for installing a colored indicator disk, b) assigning a unique identifier to each of said plurality of plugging plates, c) installing a plurality of colored indicator disks in the disk recesses, said plurality of colored indicator disks including at least one disk having a first color and at least one disk having a second color that is different than the first color, d) positioning at least one digital camera such that at least a portion of the plurality of plugging plates lie within a field of view of the at least one digital camera, e) acquiring an initial digital image (Di) of at least the portion of the plurality of plugging plates at an initial acquisition time (Ti), f) determining an initial color of each of the plurality of colored indicator disks within said initial digital image (Di), and g) creating an initial data record in a relational database for each of the plurality of plugging plates within said initial digital image (Di), said data record including:

i. the initial acquisition time (Ti), ii. the unique identifier for the plugging plate, and iii. the initial color for the colored disk at the initial acquisition time (Ti).

2. The method of claim 1, wherein the unique identifier assigned to each of said plurality of tube ends is a set of Cartesian coordinates of the form (row, column).

3. The method of claim 1, wherein steps e) through g) are performed multiple times.

4. The method of claim 1 further comprising illuminating the tube sheet with at least one light source that emits wavelengths of light within a visible light spectrum, an infrared spectrum, or an ultraviolet UV spectrum.

5. The method of claim 1, wherein the at least one digital camera detects wavelengths of light selected from one or more of the visible light spectrum, the infrared spectrum, or the ultraviolet (UV) spectrum.

6. The method of claim 1, wherein said tube sheet forms part of a heat exchanger, and said heat exchanger is one of a condenser, reboiler, preheater, boiler, superheater, quench exchanger, Transfer Line Exchanger (TLE), evaporator, waste heat boiler, recuperator, cross-exchanger and process heater.

7. The method of claim 1, wherein said tube sheet forms part of a reaction system for producing either Hydrogen Cyanide or Nitrogen Oxides.

8. The method of claim 1, wherein said tube sheet forms part of a nuclear power reactor.

9. The method of claim 1 further comprising the step of using at least a portion of the data recorded in the relational database to produce one or more of tables, graphs, spreadsheets, and color-coded summary graphics.

10. The method of claim 1, wherein said shell and tube device is utilized to perform a chemical conversion, said chemical conversion selected from the group consisting of:

i. conversion of propylene to acrolein and/or acrylic acid;
ii. conversion of propane to acrolein and/or acrylic acid;
iii. conversion of glycerol to acrolein and/or acrylic acid;
iv. conversion of tert-butanol, isobutene, isobutane, isobutyraldehyde, isobutyric acid, or methyl tert-butyl ether to methacrolein and/or methacrylic acid;
V. conversion of acrolein to acrylic acid;
vi. conversion of methacrolein to methacrylic acid;
vii. conversion of o-xylene or naphthalene to phthalic anhydride;
viii. conversion of butadiene to maleic anhydride;
ix. conversion of n-butane to maleic anhydride;
X. conversion of indanes to anthraquinone;
xi. conversion of ethylene to ethylene oxide; and
xii. conversion of propylene to propylene oxide.

11. The method of claim 1, wherein said shell and tube device is utilized to perform the oxychlorination of ethylene to 1,2-dichloroethane (EDC).

12. The method of claim 1, further comprising the step of using one or more data records stored in the relational database to produce one or more of tables, graphs, spreadsheets, and color-coded summary graphics.

13. The method of claim 1, further comprising the step of producing performance metrics for the maintenance activity, wherein the producing step comprises calculating and displaying the performance metrics in a table, graph, spreadsheet, or color-coded summary graphic.

14. The method of claim 1, further comprising predicting time-to-completion of the maintenance activity.

15. The method of claim 1, further comprising:

h) installing and/or removing a colored indicator disk on the one or more disk recesses,
i) acquiring a later digital image (Dx) of at least a portion of the plurality of plugging plates at a later acquisition time (Tx), wherein Tx>Ti,
j) determining the later color of each of the colored indicator disks within said later digital image (Dx),
k) creating a later data record in the relational database for each plugging plate within said later digital image (Dx), said later data record including:
   i. the later acquisition time (Tx),
   ii. the unique identifier for the plugging plate, and
   iii. the later color for the colored indicator disk at later acquisition time (Tx), and
l. Repeating steps h) through k) until said catalyst loading activity is complete.

16. The method of claim 1, wherein said shell-and-tube device is a shell-and-tube reactor, a tandem reactor, a single tube reactor, or a single-shell open interstage (SSOI) reactor.

17. The method of claim 15, further comprising producing one or more of tables, graphs, spreadsheets, and color-coded summary graphics using one or more of the data records stored in the relational database.

18. The method of claim 15, further comprising predicting a time-to-completion for the catalyst loading activity.

19. The method of claim 1, further comprising the steps of:

measuring one or more workspace parameters,
recording workspace parameter measurements in the relational database, and
optionally, presenting said workspace parameter measurements on a visual display.

* * * * *